US011339596B2

(12) United States Patent
Header

(10) Patent No.: US 11,339,596 B2
(45) Date of Patent: May 24, 2022

(54) DUAL TROLLEY FOR HINGED PANELS AND SEGMENTED TRACKS

(71) Applicant: Solar Innovations LLC, Pine Grove, PA (US)

(72) Inventor: Gregory A Header, Richland, PA (US)

(73) Assignee: Solar Innovations LLC, Pine Grove, PA (US)

( * ) Notice: Subject to any disclaimer, the term of this patent is extended or adjusted under 35 U.S.C. 154(b) by 397 days.

(21) Appl. No.: 16/460,909

(22) Filed: Jul. 2, 2019

(65) Prior Publication Data

US 2021/0002935 A1 Jan. 7, 2021

(51) Int. Cl.

| | |
|---|---|
| ***E05D 15/06*** | (2006.01) |
| ***E04B 2/82*** | (2006.01) |
| ***E05D 15/26*** | (2006.01) |

(52) U.S. Cl.

CPC ..... *E05D 15/0604* (2013.01); *E04B 2/827* (2013.01); *E05D 15/26* (2013.01); *E05Y 2900/142* (2013.01)

(58) Field of Classification Search

CPC ..... E05D 15/0604; E05D 15/26; E05D 15/12; E04B 2/827; E04B 2/825; E05Y 2900/142

See application file for complete search history.

(56) References Cited

U.S. PATENT DOCUMENTS

| | | | |
|---|---|---|---|
| 1,761,215 | A | 6/1930 | Lamm |
| 2,959,220 | A | 11/1960 | Latham |
| 3,042,960 | A | 7/1962 | Spork |

(Continued)

FOREIGN PATENT DOCUMENTS

| | | | | |
|---|---|---|---|---|
| CA | 3081874 | A1 * | 12/2020 | ..... E05D 15/56 |
| DE | 19739688 | C2 | 4/2000 | |

(Continued)

OTHER PUBLICATIONS

Dual Helical Trolley for Hinged Panels, Unlisted YouTube Video, Solar Innovations, Inc. on behalf of the Applicant, Gregory A. Header, May 30, 2018. The video is private as of Nov. 7, 2019. Accessed on the Internet by a privately shared and unlisted URL: https://www.youtube.com/watch?v=jawrtwPI2mw&feature=youtu.be on May 30, 2018. Important Note: The video transcript for the above was submitted under MPEP §724.02 for the Examiner's review.

(Continued)

*Primary Examiner* — Beth A Stephan
(74) *Attorney, Agent, or Firm* — Stone Creek Services LLC; Alan M Flum

(57) ABSTRACT

A folding panel system that allows foldable panels, such as folding glass doors, to fold and move around segmented tracks. The system includes a trolley assembly. The trolley assembly can include a pair of dual roller assemblies spaced rigidly apart by a rigid guide member and supported by an overhead guide track. The rigid guide member is positioned outside of the guide track and moves lengthwise along the overhead guide track except between overhead linear track segments. A hinge extension is secured to and extends rigidly away from the rigid guide member vertically away from the guide track. This configuration holds the hinge extension at a constant angle with respect to the guide track. The hinge extension pivotably joins hinge leaves from adjacent panels hingedly joining the two panels.

20 Claims, 28 Drawing Sheets

(56) References Cited

U.S. PATENT DOCUMENTS

| | | | | |
|---|---|---|---|---|
| 3,798,839 | A | 3/1974 | Kaufman | |
| 3,829,175 | A | 9/1974 | Vogeli | |
| 3,879,799 | A | 4/1975 | Williams | |
| 4,401,033 | A | 8/1983 | Gerken | |
| 5,042,554 | A | 8/1991 | Schmidt | |
| 5,181,296 | A | 1/1993 | Williams | |
| 5,230,123 | A | 7/1993 | Williams et al. | |
| 5,448,855 | A | 9/1995 | Sjoholm | |
| 6,374,456 | B1 | 4/2002 | Fort et al. | |
| 6,581,242 | B2 | 6/2003 | Owens | |
| 6,618,900 | B2 | 9/2003 | Spork et al. | |
| 6,834,703 | B2 | 12/2004 | Pacholke et al. | |
| 8,074,699 | B2 | 12/2011 | Jones et al. | |
| 8,590,233 | B2 | 11/2013 | Sprague | |
| 9,032,588 | B2 * | 5/2015 | Chen | E06B 7/28 16/87.6 R |
| 9,470,082 | B1 | 10/2016 | Header | |
| 10,077,588 | B1 * | 9/2018 | Header | E05D 15/0608 |
| 10,087,668 | B2 * | 10/2018 | Wang | E05D 15/0652 |
| 10,557,297 | B2 * | 2/2020 | Stenhouse | E05D 15/264 |
| 10,604,930 | B2 * | 3/2020 | Downey | E05D 15/0626 |
| 2001/0011583 | A1 | 8/2001 | Spork | |
| 2006/0283104 | A1 | 12/2006 | Schneider | |
| 2007/0029057 | A1 | 2/2007 | Schneider | |
| 2007/0272372 | A1 * | 11/2007 | Glover | E06B 3/9647 160/206 |
| 2008/0060274 | A1 | 3/2008 | Vooght | |
| 2011/0079762 | A1 | 4/2011 | Adderton | |
| 2013/0186038 | A1 | 7/2013 | Lang | |
| 2015/0000082 | A1 * | 1/2015 | Lang | E05D 7/0423 16/248 |
| 2016/0024826 | A1 * | 1/2016 | Smith | E05D 15/0604 160/197 |
| 2017/0298668 | A1 | 10/2017 | Lang et al. | |

FOREIGN PATENT DOCUMENTS

| | | | | |
|---|---|---|---|---|
| DE | 19828336 | B4 | 2/2014 | |
| DE | 102011121359 | B4 | 1/2017 | |
| EP | 2622161 | B1 | 6/2015 | |
| EP | 3150786 | A1 | 4/2017 | |
| GB | 308540 | A | 7/1928 | |
| GB | 701949 | A | 5/1954 | |
| GB | 2533286 | B | 8/2017 | |
| HU | E029968 | T2 * | 4/2017 | E05D 15/12 |
| NZ | 547110 | A | 11/2007 | |
| WO | 0011298 | A1 | 3/2000 | |

OTHER PUBLICATIONS

Trolley around 60 Degree Angle, Unlisted YouTube Video, Solar Innovations, Inc. on behalf of the Applicant, Gregory A. Header, May 31, 2018. The video is private as of Nov. 7, 2019. Accessed on the Internet by a privately shared and unlisted URL: https://www.youtube.com/watch?v=ttkhHtuHPH8&feature=youtu.be on May 31, 2018. Important Note: The video transcript for the above was submitted under MPEP §724.02 for the Examiner's review.

Dual Helical Trolley for Hinged Panels, Unlisted YouTube Video, Solar Innovations, Inc. on behalf of the Applicant, Gregory A. Header, May 22, 2018. The video is private as of Jun. 24, 2020. Accessed on the Internet by a privately shared and unlisted URL: https://www.youtube.com/watch?v=jawrtwPI2mw&feature=youtu.be on May 30, 2018. Important Note: The video transcript for the above was submitted under MPEP §724.02 for the Examiner's review.

Change video privacy settings, About privacy settings section, YouTube, Alphabet Inc. (Google), Mountain View, California, downloaded from the Internet from https://support.google.com/youtube/answer/157177 on Jun. 23, 2020.

Vista Fold Wood Installation Instructions, Nov. 2017, Euro-Wall Systems, LLC, North Port, Florida.

NanaWall Curved Folding System, screenshots from video, downloaded from the Internet from www.nanawall.com/curved-folding-system on May 23, 2018.

Curved Track Sliding Door Hardware, downloaded from the Internet from http://www.janetech.co/curved-barn-door-track/sliding-barn-doors-sliding-barn-door-track.html on May 23, 2018.

NanaWall HSW60 The Thermally Broken Aluminum Framed Singe Track Sliding System, Jan. 2013, NanaWall Systems, Inc. , Corte Madera, California.

Folding Sliding Door System SF75H Insulated Wood System, Oct. 2013, Sunflex Wall Systems LP, Naples, Florida.

Slide and Turn System SF25 Frameless All-Glass/Non Insulated, Feb. 2017, Sunflex Wall Systems LP, Naples, Florida.

Slide and Turn System SF30, Jun. 2017, Sunflex Wall Systems LP, Naples, Florida.

Folding Sliding System SF75, Jul. 2017, Sunflex Wall Systems LP, Naples, Florida.

Vario Curved Modern Sliding Hardware Kit, downloaded from the Internet at https://barndoorhardware.com/products/vario-curved-modern-sliding-hardware-kit/ on May 23, 2018.

Sun WT Freigabe2, YouTube video, viewed on the Internet at https://www.youtube.com/watch?v=kGPDeQ6NVdM on Jun. 6, 2019.

* cited by examiner

DUAL TROLLEY FOR HINGED PANELS AND SEGMENTED TRACKS

BACKGROUND

The present disclosure relates to fenestration systems. Specifically, this disclosure relates folding panel assemblies that are movable through overhead tracks.

Folding panels are used in a wide range of applications. These include folding closet doors, folding room partition, folding glazed door panels, folding glazed terrace doors, and folding glazed store front openings. Collectively folding glazed door panels, folding glazed terrace doors, and folding glazed store front openings, are referred to in this disclosure, for brevity as folding glass walls.

Folding glass walls allow a room, storefront or other enclosed space to be quickly transformed into an open space. Unlike standard windows or doors, the folding glass wall can be folded up to the ends of the fenestration opening, creating a nearly a complete opening. For example, a living room can be converted into a covered patio space. Two store fronts or meeting rooms can be merged into one.

Folding glass walls and other folding partitions often use overhead tracks and optionally tracks in the floor. The overhead tracks can be used in combination with trolleys, rollers, and similar devices extending from the folding partitions to guide the folding partitions along the overhead tracks. Similarly, trolleys, rollers, pins, or similar guiding devices extending from the bottom of the folding partitions can guide the folding partitions along the tracks in the floor. The folding glass walls can be either suspended by the overhead track or supported by the bottom track. When suspended by the overhead track, or top-loaded, the bottom track can be used to align the folding partition and secure the panel against negative and positive pressure from wind loads and other environmental factors. When supported by the bottom track, or bottom-loaded, the overhead tracks can be used to align the folding partition and secure the panel against negative and positive pressure from wind loads and other environmental factors.

The folding glass walls and other folding partitions typically fold along a linear path along a flat or planar opening that is typical of many fenestration openings. However, since not all openings are planar, some manufacturers have developed folding partitions that accommodate radiused and segmented openings. For example, a folding partition that accommodates an opening of a building with a radiused outer profile, or a folding glass wall that opens around the corner of the building. Typically, folding partition systems for segmented openings is actually constructed as a series of planar folding partitions with a separate folding partition or folding wall for each segment. For example, for a folding glass wall that opens around the corner of the building, the folding partition system can include two planar openings each with a linear track and a corresponding folding glass wall. Each folding glass wall can fold away from the corner toward the respective opposite ends of the wall. This arrangement leaves both walls, including the corner between the two walls, completely open creating a clean and open look.

SUMMARY

While the above solution works to open up single corners, the inventor noted that the one of the core problems is that trolleys typically used for folding glass walls and other folding panel systems cannot fold and then move along a track with steep overhead linear track segments. For example, suspended trolleys typically used in folding panel systems cannot perform with overhead linear track segments that have an angle less than 130°. The inventor observed that suspended trolleys with vertical wheels or rollers tend to jamb when going from one segment to another. The inventor also observed that suspended trolleys using horizontal rollers or helical bearings that extend from the hinge that joins the door panels together will pivot, causing the doors to jamb against each other.

The inventor developed suspended folding panel system that allows the suspended panels to move along an overhead guide track between relatively steep segments. The suspended folding panel system, developed by the inventor, includes two top-loaded dual roller assemblies that move within an overhead guide track that are spaced apart by a rigid guide member that lies outside the overhead guide track. The rigid guide member is suspended directly under the overhead guide track and except for the guide track junctions, moves along the lengthwise centerline of the overhead guide track. A hinge extension rigidly extends from the rigid guide member beyond the overhead guide track width and joins the hinge leaves on each suspended panel together. This configuration assures that the hinge extension will maintain a constant angle with respect to the guide track except at the guide track junction. For example, if the hinge extension is positioned 90° with respect to the length of the trolley body, then the hinge extension will maintain a 90° with respect to the guide track, except at the guide track junction.

The inventor envisions his suspended folding panel system to accommodate several styles of top-loaded dual roller assemblies. For example, top-loaded dual roller assemblies could be vertically stacked helical bearings or vertically-wheeled horizontal trolleys. The vertically-wheeled horizontal trolleys have a linear degree of freedom via the vertical wheels and each have a rotational degree of freedom by separate shafts spaced apart by the rigid guide member. The trolley assemblies with vertically stacked helical bearings can share common structure with the vertically-wheeled horizontal trolleys. These structural similarities allow the suspended trolley assembly to traverse a segmented track and do so with stability. With both trolley assemblies, the dual roller assemblies are rigidly spaced apart by the rigid guide member and rigidly attached to the hinge extension at a fixed angle, typically 90°. The rigid guide member is positioned outside and below the overhead guide track. The hinge extension being positioned between the hinged suspended panels in combination with the fixed angle between the hinge extension and the rigid guide member allows the suspended door assembly to move along the overhead guide track and between overhead linear track segments independent of whether or not the door is folded or unfolded.

In addition, the inventor envisions his folding panel system to accommodate several styles of bottom-loaded roller assemblies following principles of operation similar to his suspended folding panel system. For example, the vertically-wheeled horizontal trolleys could be adapted to be bottom-loaded by devising a hinge extension that extends and functions in a similar manner to the hinge extensions described above. The hinge extension would position the rigid guide member above the sill track (i.e., outside the sill track). The dual roller assemblies are rigidly spaced apart by the rigid guide member and rigidly attached to the hinge extension at a fixed angle, typically 90°. The sill track would support the dual rollers. The overhead guide track would be used to top align the panels and secure the panel against negative and positive pressure from the environment, for example, against wind pressure.

This Summary introduces a selection of concepts in simplified form that are described in the Description. The Summary is not intended to identify essential features or limit the scope of the claimed subject matter.

DRAWINGS

DESCRIPTION

Figure 1:
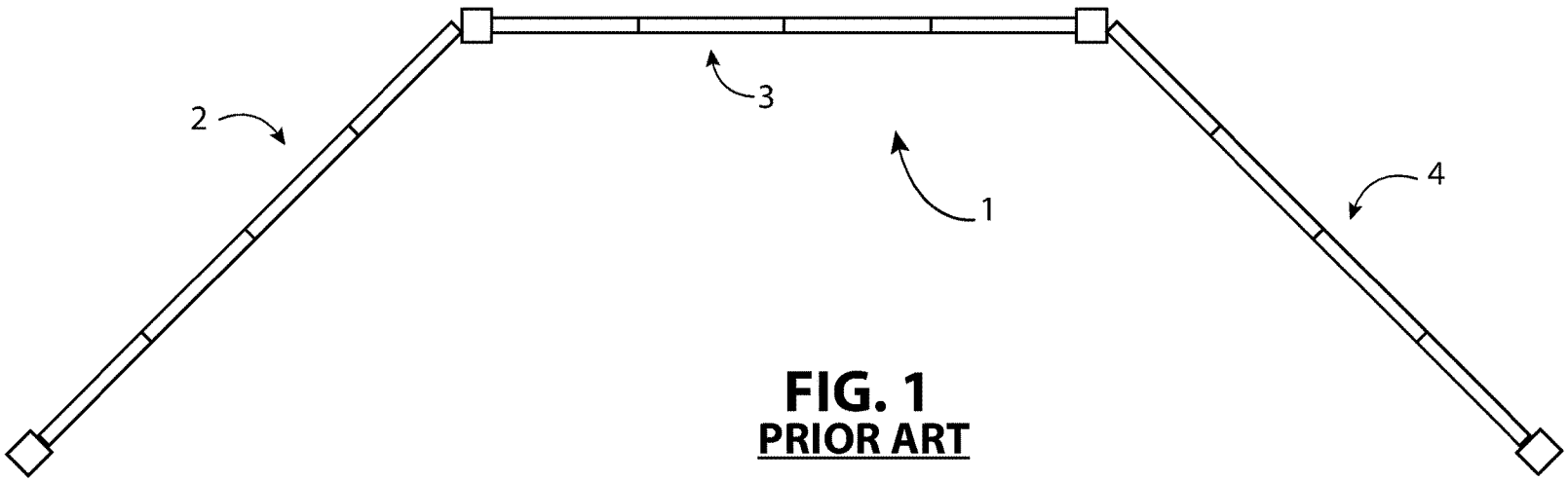
FIG. 1 PRIOR ART
FIG. 1 illustrates a top plan view of a fenestration opening with a segmented track in the prior art with folding panels in the closed position

The terms "left," "right," "top, "bottom," "front," "back," and "side," are relative terms used throughout the to help the reader understand the figures. Unless otherwise indicated, these do not denote absolute direction or orientation and do not imply a particular preference. When describing the figures, the terms "top," "bottom," "front," "rear," and "side," are from the perspective of looking toward folding hinge side being the front. Specific dimensions are intended to help the reader understand the scale and advantage of the disclosed material. Dimensions given are typical and the claimed invention is not limited to the recited dimensions. The use of ordinals such as first, second, or third are used as a naming convention. They do not denote that one feature, embodiment, or structure is superior or inferior to another.

The following terms are defined for clarity and convenience.

Suspended or Top-Loaded:

As defined in this disclosure, suspended or top-loaded means being suspended by an overhead guide track or a track segment of an overhead guide track. For example, a suspended trolley assembly is suspended by an overhead guide track. The suspended trolley assembly would suspend a corresponding door or other panel by the overhead guide track. A top-loaded roller assembly or top-loaded dual roller assembly is a roller assembly suspended by an overhead guide track. A suspended panel is a panel suspended by an overhead guide track, typically by suspended trolleys or top-loaded roller assemblies within the suspended trolley. Panels suspended by suspended trolleys or top-loaded roller assemblies may also use a sill track or bottom guide track for guidance, but the weight of the panel is supported by the overhead guide track. This is in contrast to non-suspended trolleys where the weight of the trolley is typically supported either on the floor or within a sill track.

Bottom-Loaded:

As defined in this disclosure, bottom-loaded means being supported by sill track or bottom guide track or a track segment of a sill track. For example, a bottom-loaded trolley assembly is supported by sill track. The bottom-loaded trolley assembly would support a corresponding door or other panel by the sill track. A bottom-loaded roller assembly is a roller assembly supported by a sill track. A bottom-loaded panel is a panel supported by sill track, typically by bottom-loaded trolleys or bottom-loaded roller assemblies within the bottom-loaded trolley. Panels supported by bottom-loaded trolleys or bottom-loaded roller assemblies may also use an overhead track for guidance and to secure the panel against negative and positive pressure caused by wind and other environmental factors. However, the weight of the panel is supported by the sill track.

The following description is made with reference to figures, where like numerals refer to like elements throughout the several views.

As discussed in the Background, folding partitions, such as glass doors, allow a room, storefront or other enclosed space to be quickly transformed into an open space. Unlike standard windows or doors, the folding glass walls and other folding partitions can be folded up to the ends of the fenestration opening.

Figure 2:
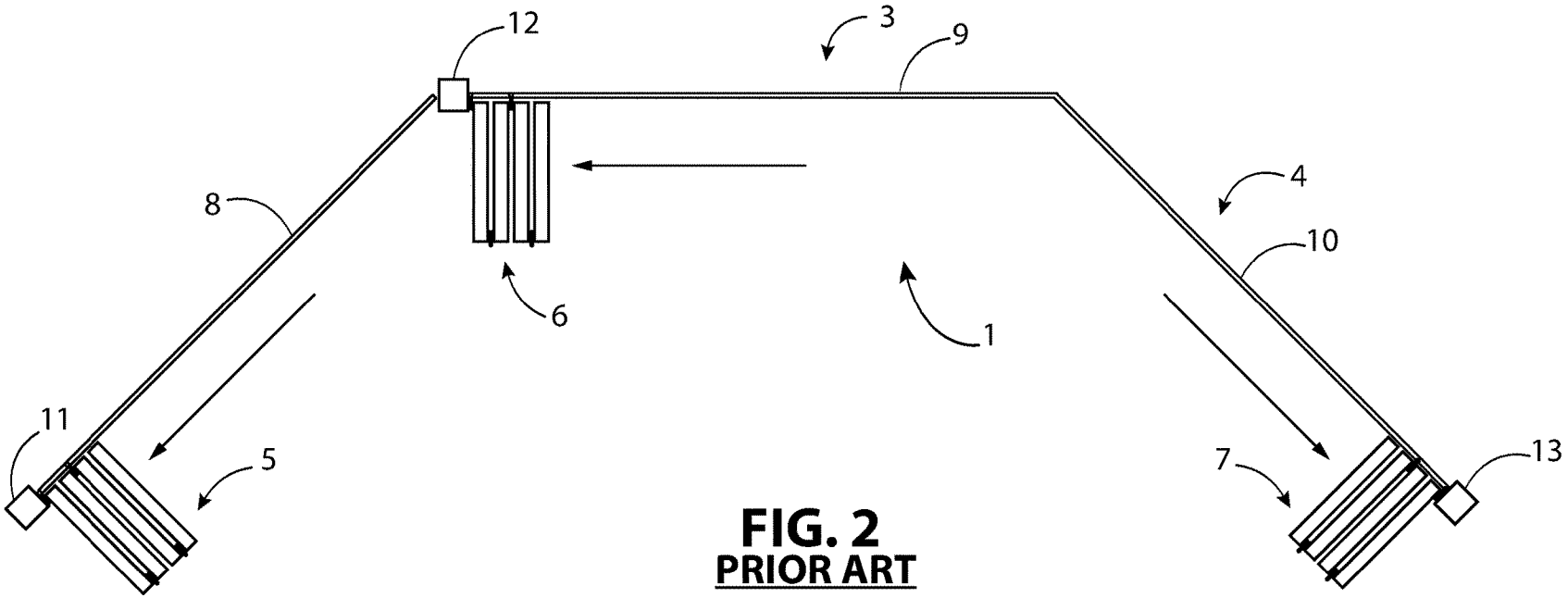
FIG. 2 PRIOR ART
FIG. 2 illustrates a top plan view of the fenestration opening of FIG. 1 with the folding panels in the fully opened position.

While folding partitions typically fold along a linear path and a flat or planar opening, some buildings require an opening that is not in a single plane or along a linear path. For example, FIGS. 1 and 2 illustrate, in the prior art, a building fenestration 1 with foldable glass partitions along three sides or segments. Referring to FIG. 1, the segmented openings are constructed as a series of planar opening 2, 3, 4. Referring to FIGS. 1 and 2, each panel opening includes foldable partitions 5, 6, 7. Referring to FIG. 2, the foldable partitions 5, 6, 7 fold and move along linear overhead guide tracks 8, 9, 10. Foldable partition 5 can be stowed against vertical column 11, foldable partition 6 can be stowed against vertical column 12, and foldable partition 7 can be stowed against vertical column 13. In this example, foldable partition 6 and foldable partition 7 are each folded and moved away from each other, creating a continuous opening between planar openings 3, 4.

While the solution of FIGS. 1 and 2 creates a continuous opening for one corner (i.e., two overhead linear track segments), the inventor noted that trolleys typically used for folding glass walls and other folding panel systems cannot fold and then move along a track with steep angles between track segments. This prevents trolley systems like in FIGS. 1 and 2 from creating continuous openings over more than two segments.

Figure 3:
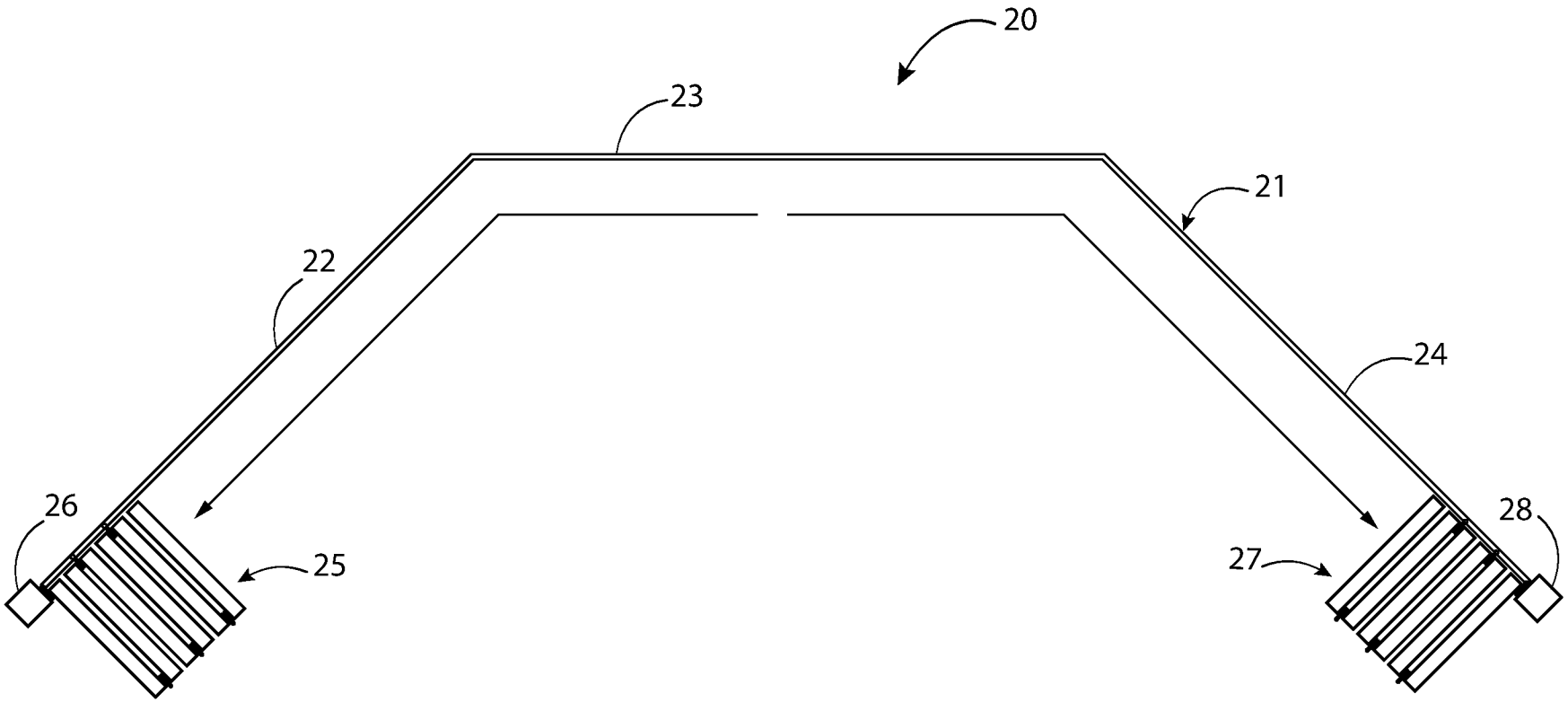
FIG. 3 illustrates a top plan view of a fenestration opening with a continuous segmented track utilizing the suspended trolley assembly of the present disclosure and with suspended folding panels in the fully opened position.

Referring to FIG. 3, the inventor developed a suspended folding panel system 20 capable of folding and transacting an overhead guide track 21 with multiple continuous overhead linear track segments, for example, overhead linear track segments 22, 23, 24. As illustrated in FIG. 3, foldable partition 25 folds fully against column 26 or jamb on the left-hand side of the figure and foldable partition 27 folds and slides fully against column 28 or jamb on the right-hand side of the figure. This creates a continuous fenestration opening that spans the junction between overhead linear track segment 22, 23 and the junction between overhead linear track segment 23, 24. Alternatively, the foldable partitions 25, 27 do not have to be secured to columns 26, 28, respectively. The foldable partitions 25, 27 can be free floating. In addition, foldable partitions 25, 27 can have more or fewer foldable segments than illustrated. The segments within foldable partition 25 need not all be connected, but can be separated into multiple free floating sections.

Figure 4:
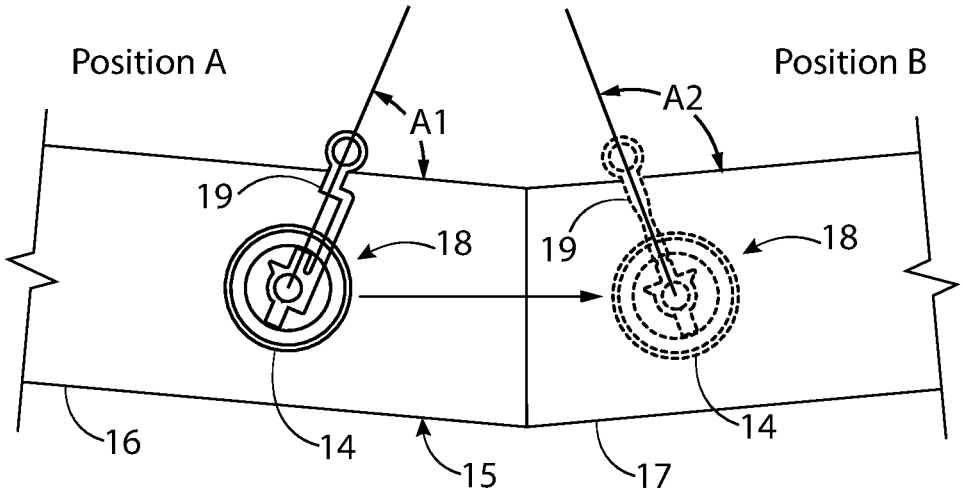
FIG. 4 PRIOR ART
FIG. 4 illustrates a simplified top plan view of a trolley system in the prior art illustrated in two positions.

Suspending doors by trolleys requires stability. This is especially true for suspended glazed doors that can weigh several hundred kilograms. The inventor observed that trolleys using horizontal rollers or helical bearings, such as helical bearing 14 shown in FIG. 4, in the prior art, can work fine on a linear overhead guide track, but can be unstable on a continuous segmented track, for example overhead guide track 15 comprising overhead linear track segments 16, 17. FIG. 4 illustrates the suspended trolley assembly 18 in two positions. In position A, the suspended trolley assembly 18 is positioned in overhead linear track segment 16. In position B, the suspended trolley assembly 18 is positioned in overhead linear track segment 17. In position A, as the door is pulled along overhead linear track segment 16, the hinge extension 19 that connects the helical bearings 14 to the hinges of doors, will tend to form an acute angle, shown as angle A1, with respect to the overhead linear track segment 16. As the door is pushed past the junction between the overhead linear track segments 16, 17, the angle between the hinge extension 19 and the overhead linear track segment 17 will shift as the suspended trolley assembly 18 moves into position B. Here shown as an oblique angle, angle A2. As an example, angle A1 is illustrated as approximately 70° and angle A2 is illustrated as approximately 105°. This creates instability and can make the door panels difficult to push or pull.

Figure 5:
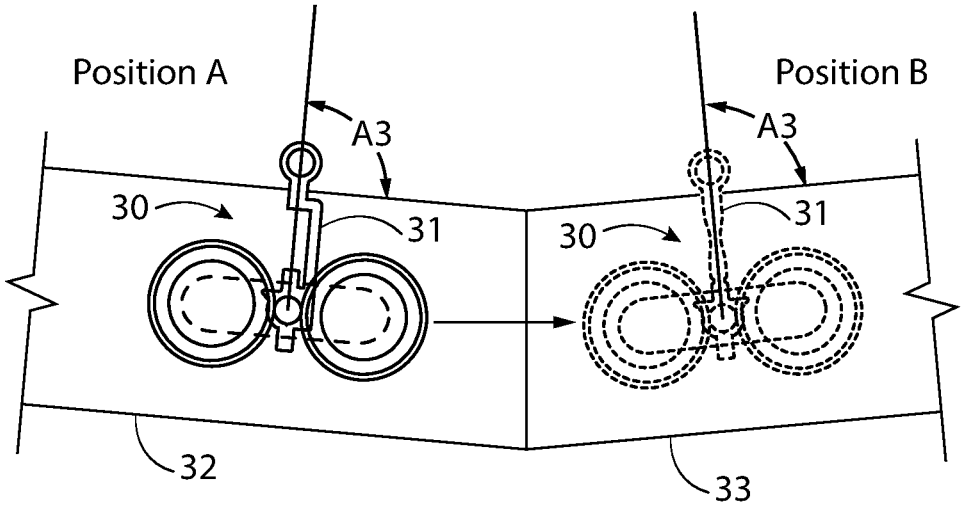
FIG. 5 illustrates a simplified top plan view of the suspended folding panel system of the present disclosure illustrated in two positions.

In contrast, in FIG. 5, the hinge extension 31 of the suspended trolley assembly 30 developed by the inventor maintains a constant angle with respect to the first linear track segments 32 and the second linear track segment 33.

The exception being when the suspended trolley assembly 30 is suspended by both the first linear track segment 32 and the second linear track segment 33. This is shown as angle A3. Angle A3 is illustrated as approximately 90°. This constant angle helps make the suspended folding panel system of FIG. 3 stable and easy to push or pull.

Figure 6:
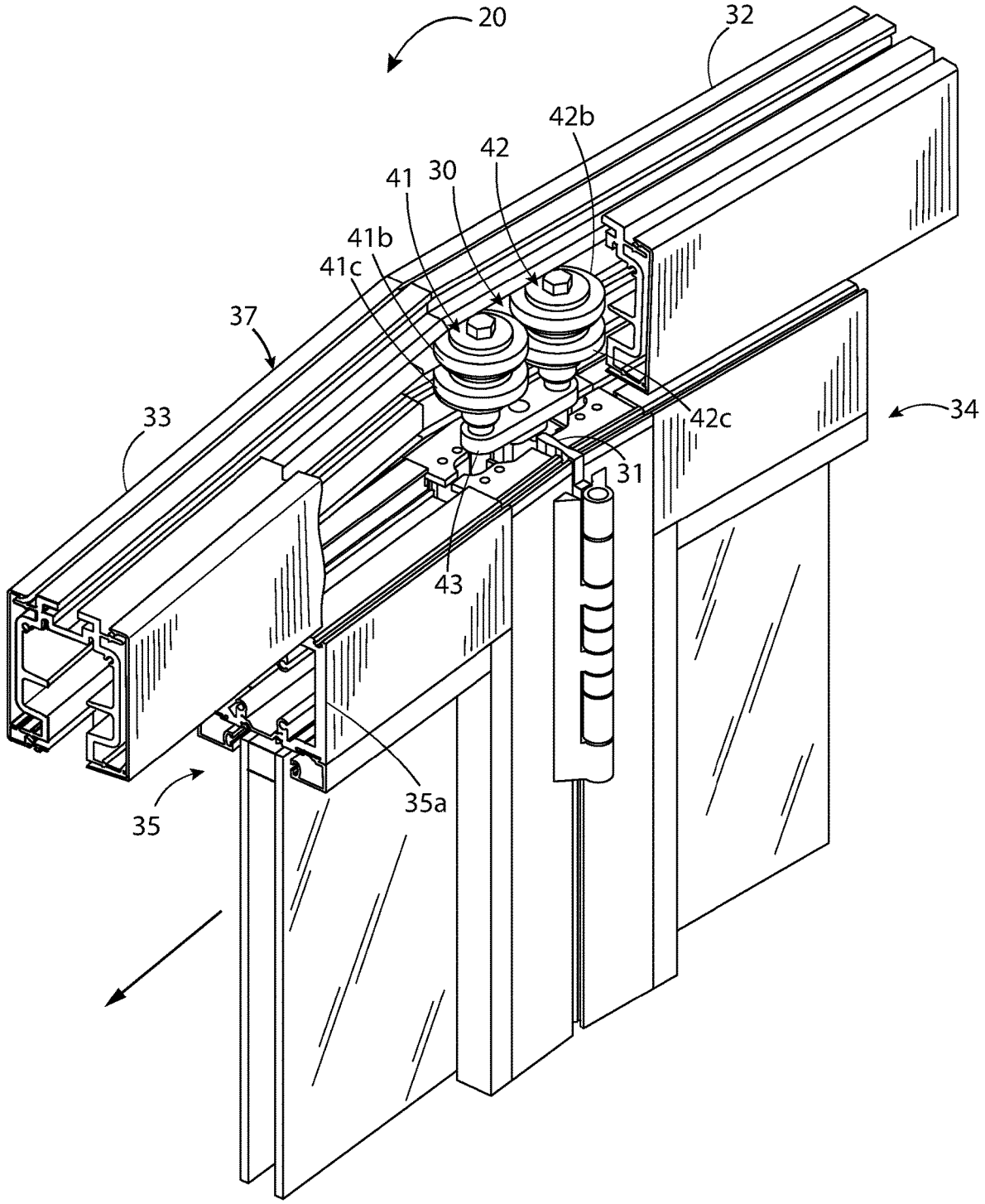
FIG. 6 illustrates a suspended trolley assembly, suspended folding panels, and overhead guide track of the present disclosure, in front perspective view, with the overhead guide track partially cutaway to show the trolley positioned to left of the linear track segment.
Figure 7:
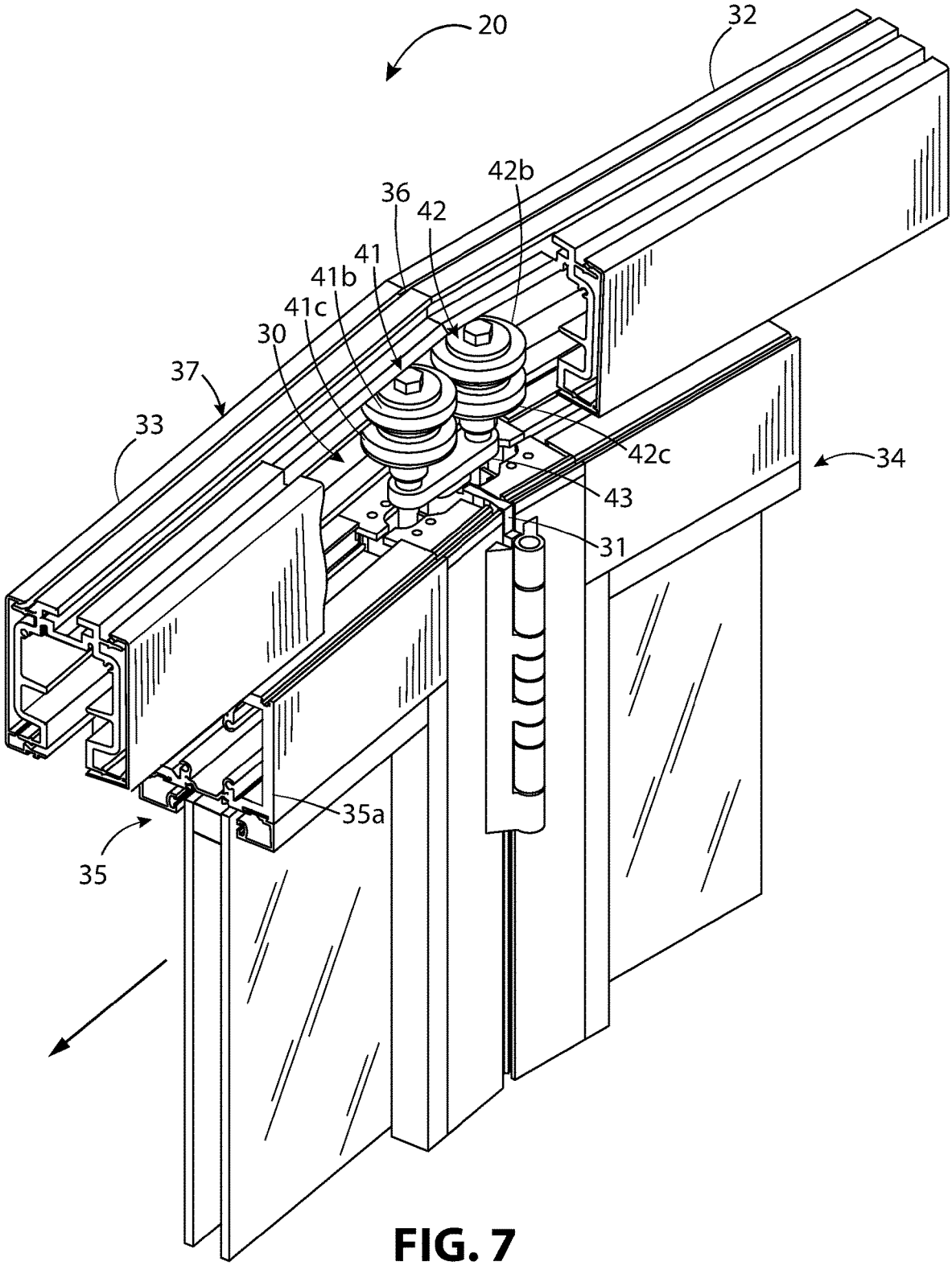
FIG. 7 illustrates the suspended trolley assembly, suspended folding panel, and overhead guide track assembly of the present disclosure in front perspective view, with the overhead guide track partially cutaway to show the trolley positioned at the linear track segment.
Figure 8:
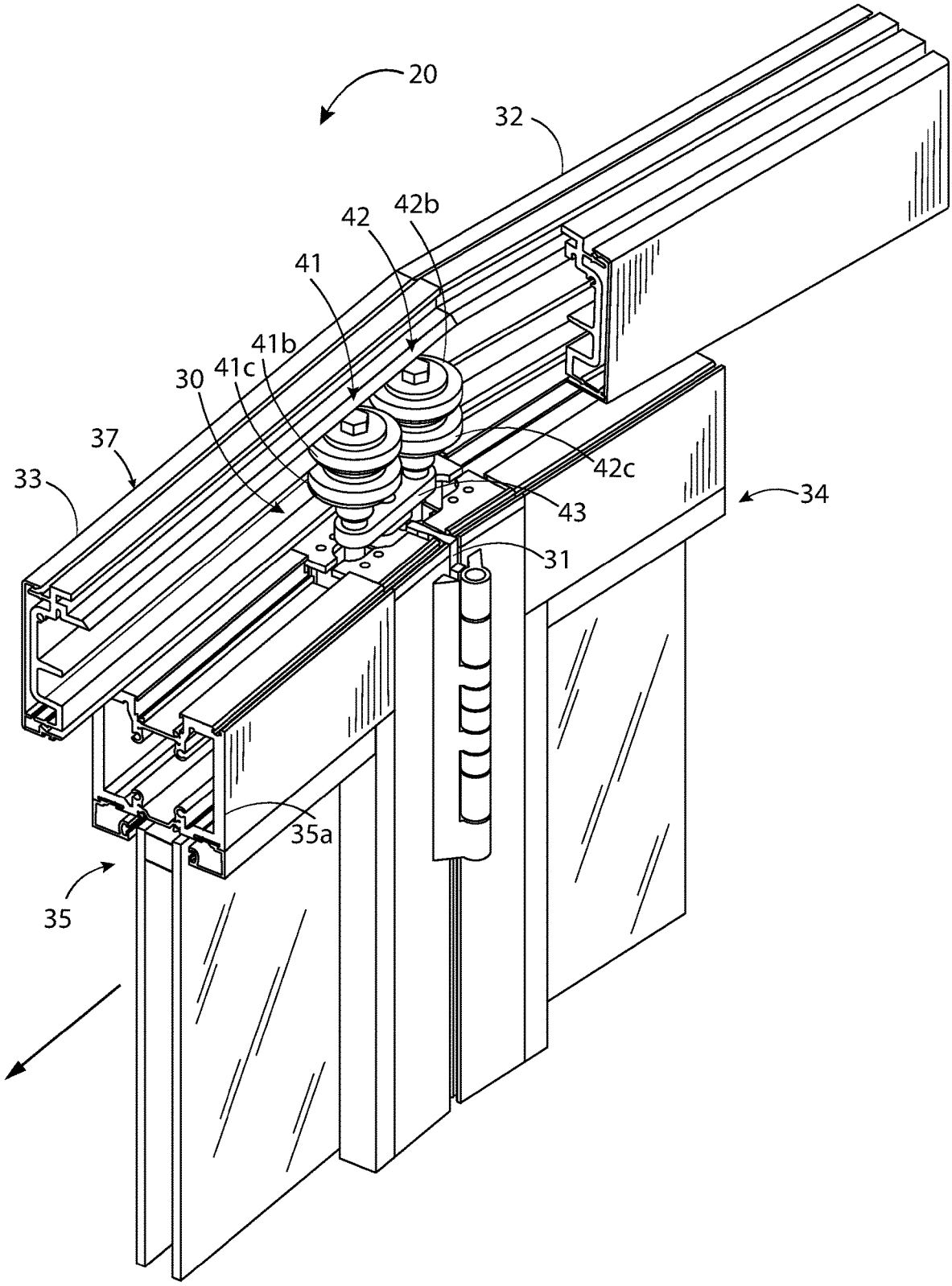
FIG. 8 illustrates the suspended trolley assembly, suspended folding panel, and overhead guide track assembly of the present disclosure in front perspective view, with the overhead guide track partially cutaway to show the trolley positioned to the right of the linear track segment.

Referring to FIGS. 6-8, a portion of the suspended folding panel system 20, of the present disclosure, is illustrated with the suspended trolley assembly 30 suspending a first panel 34 and a second panel 35 to the first linear track segments 32 and the second linear track segment 33 of overhead guide track 37. The second linear track segment 33 can extend either perpendicularly or obliquely away from the first linear track segment 32, i.e., the first linear track segment 32 and the second linear track segment are not parallel. The overhead guide track 37 with a portion of the front of the overhead guide track 37 cutaway to show portions of the suspended trolley assembly 30 and their relation to the overhead guide track 37. In FIG. 6, the suspended trolley assembly 30 is positioned suspended from the first linear track segment 32, similar to position A in FIG. 5. In FIG. 8, the suspended trolley assembly 30 is positioned suspended from second linear track segment 33, similar to position B in FIG. 5. In FIG. 7, the suspended trolley assembly 30 is suspended by both the first linear track segment 32 and the second linear track segment 33 as it passes over the junction 36 the between the first linear track segments 32 and the second linear track segment 33. Whether the door is folded or open, as illustrated in FIGS. 6-8, 19, and 20 the hinge extension 31 of the suspended trolley assembly 30 maintains a constant angle with the respective overhead guide track 37. Referring to FIG. 7, the exception being when the suspended trolley assembly 30 is passing through both first linear track segments 32 and the second linear track segment 33. Referring to FIG. 6, for example, when the suspended trolley assembly 30 and door panels are suspended by the first linear track segment 32, the hinge extension 31 maintains a constant angle with respect to first linear track segment 32. Referring to FIG. 8, when the suspended trolley assembly 30, first panel 34, and the second panel 35 are suspended by second linear track segment 33, the hinge extension 31 maintains a constant angle with respect to second linear track segment 33. The hinge extension 31 in both cases is illustrated making a 90° angle with respect to the respective first linear track segment 32 and the second linear track segment 33.

Figure 9:
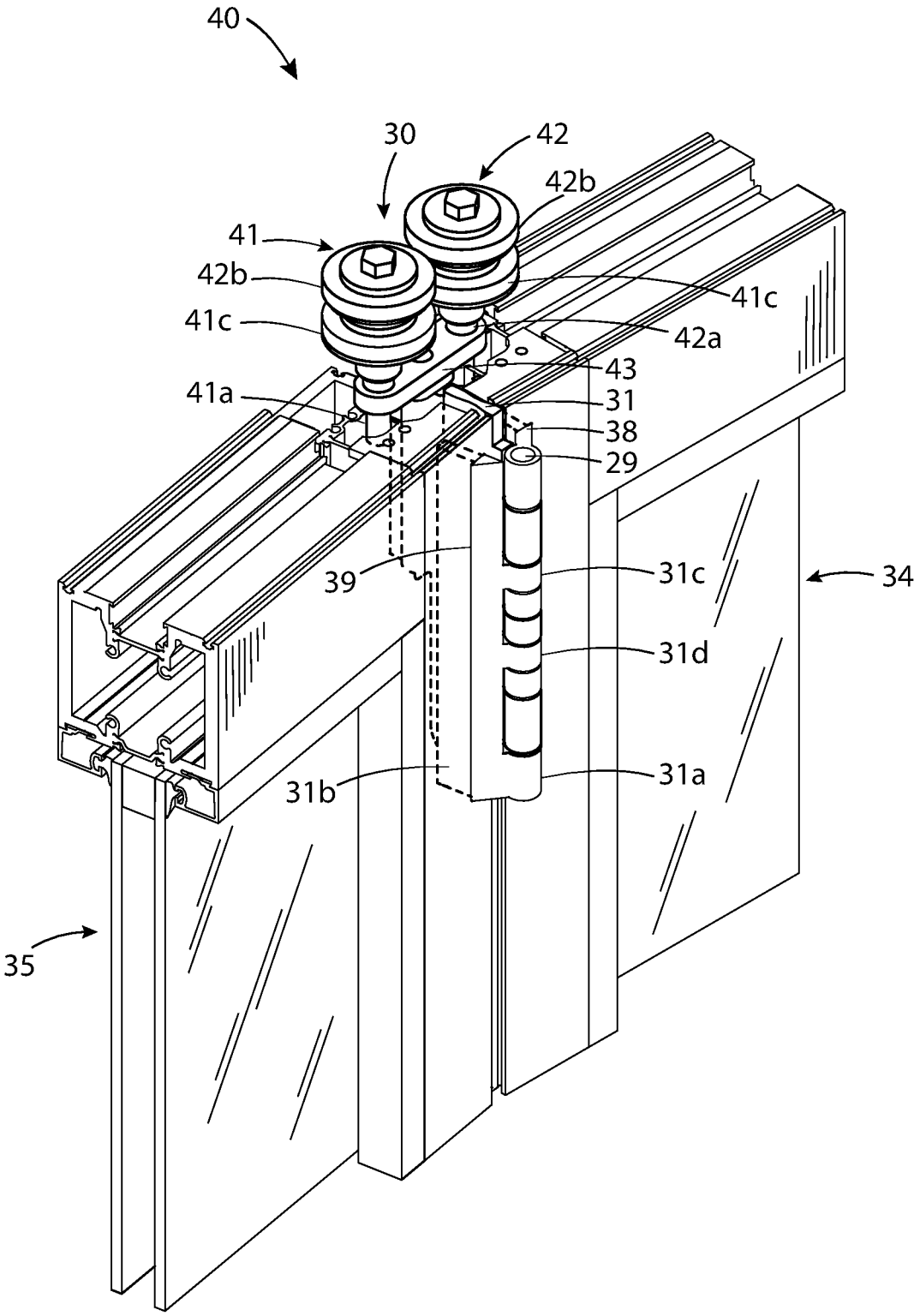
FIG. 9 illustrates the suspended trolley assembly and suspended folding panels in front perspective view with portions of the suspended trolley assembly hidden from view illustrated with broken lines.
Figure 10:
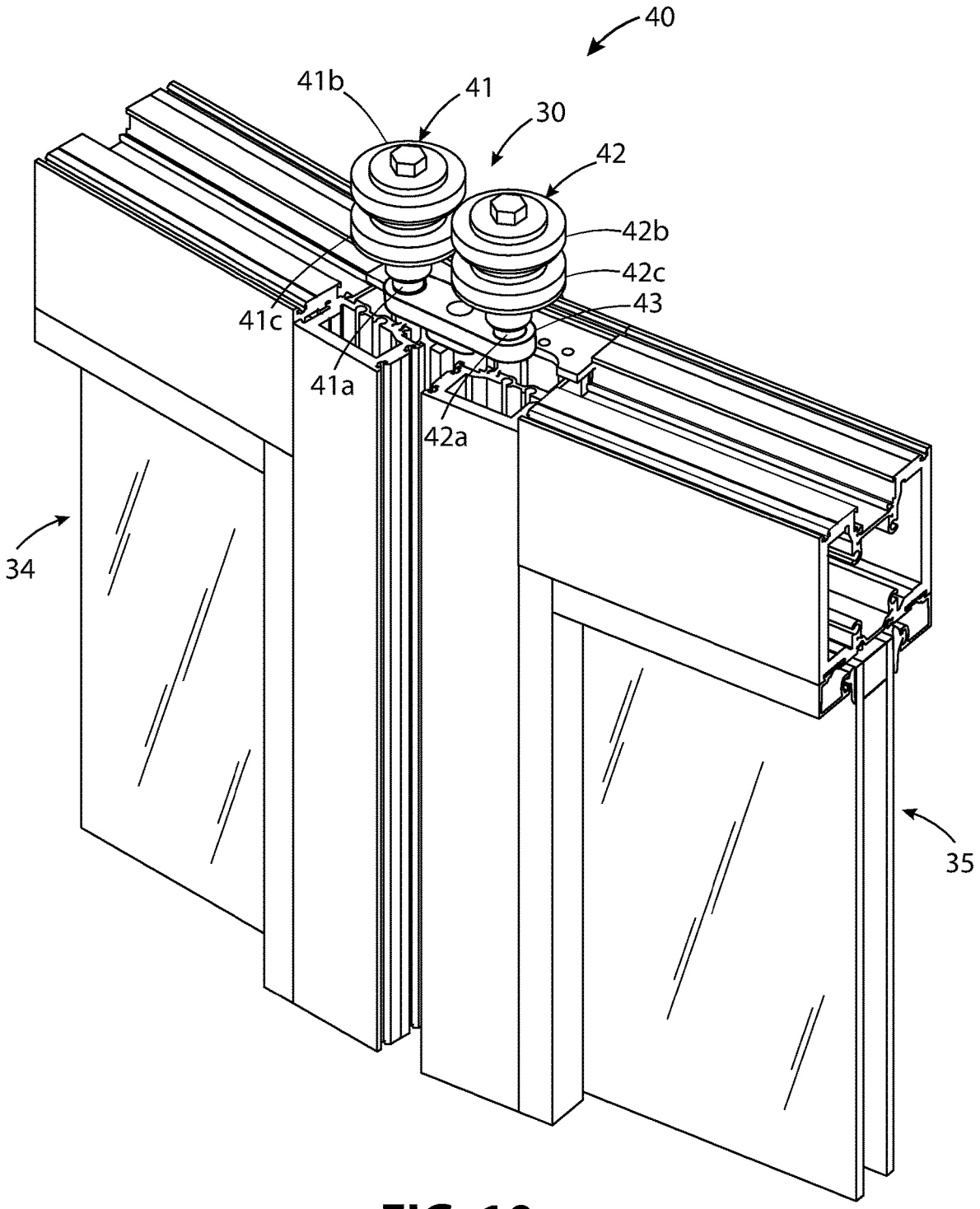
FIG. 10 illustrates the suspended trolley assembly and suspended folding panels of FIG. 9 in rear perspective view.
Figure 16:
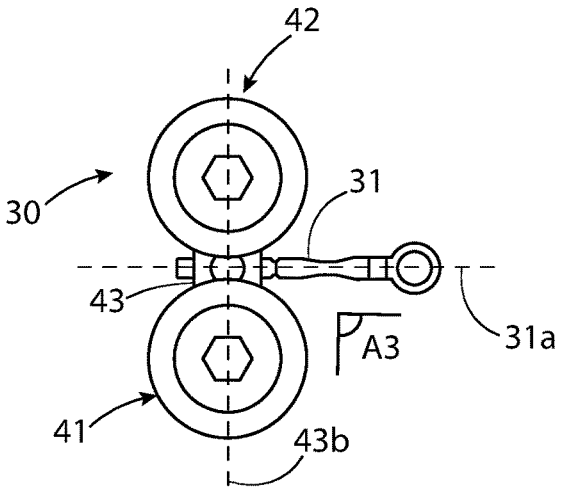
FIG. 16 illustrates a top view of the suspended trolley assembly of FIG. 11.
Figure 17:
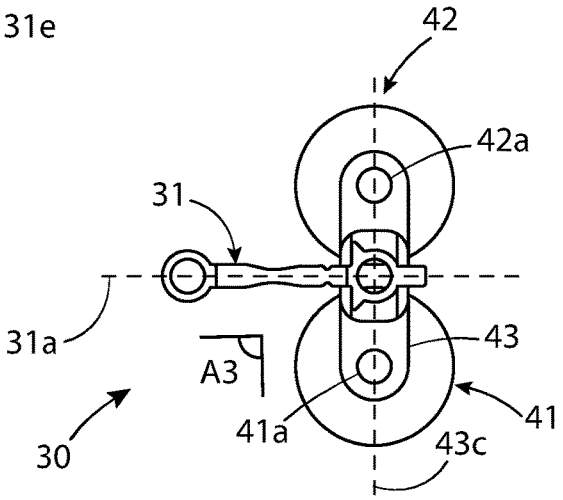
FIG. 17 illustrates a bottom view of the suspended trolley assembly of FIG. 11.
Figure 18:
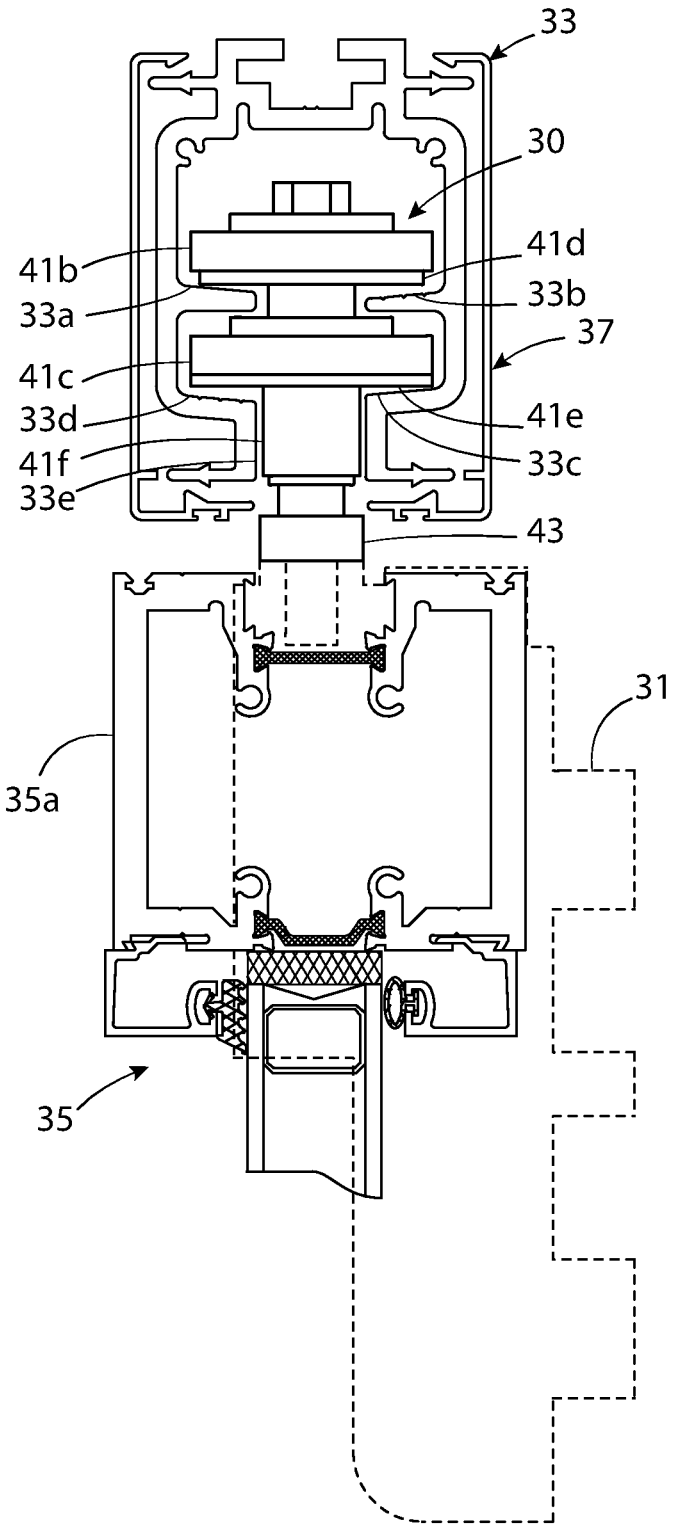
FIG. 18 illustrates a side view of the suspended trolley assembly showing its relation to the overhead guide track and the door panel with the hinge extension outlined in dashed lines for ease of viewing.
Figure 19:
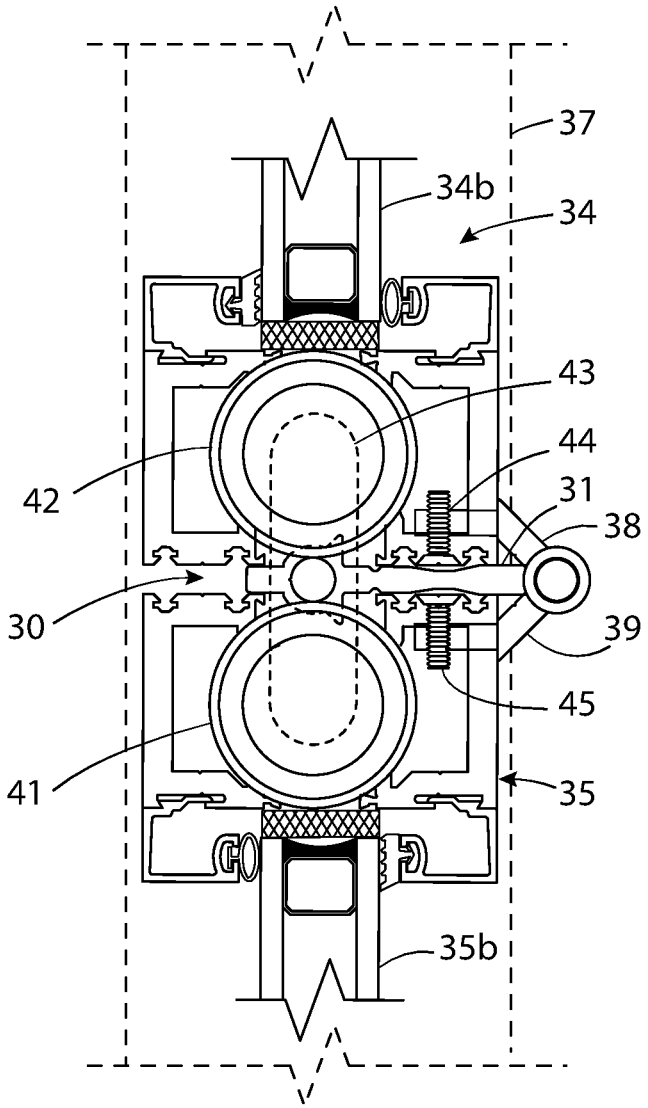
FIG. 19 illustrates a top plan view of the suspended trolley assembly, suspended folding panels, and overhead guide track, with the overhead guide track simplified and outlined with broken lines for ease of viewing.
Figure 20:
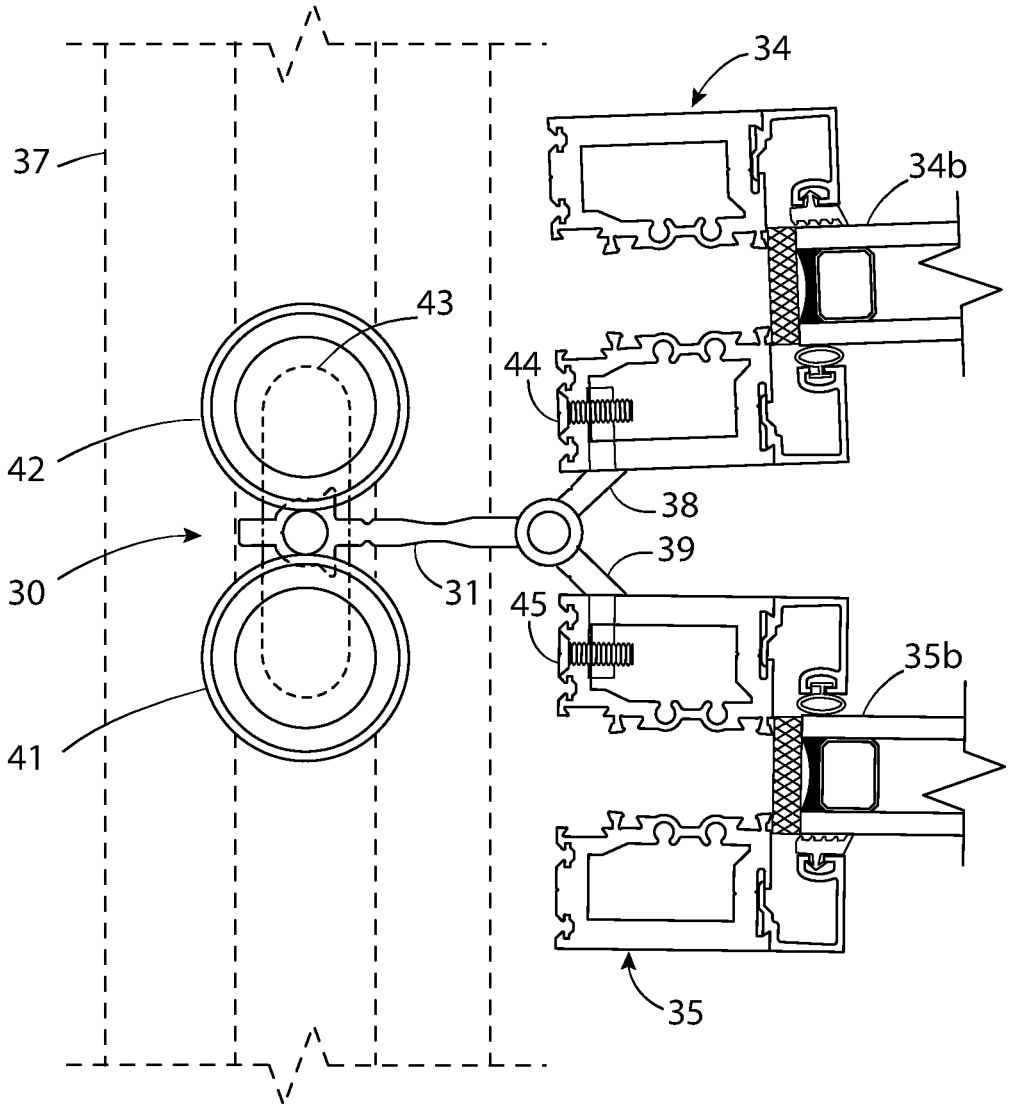
FIG. 20 illustrates a top plan view of the assembly of FIG. 19 with the suspended folding panels in the open position.

FIGS. 9 and 10 illustrate the door assembly 40 portion of the suspended folding panel system 20 of FIGS. 6-8. FIG. 9 illustrates front perspective view showing the first hinge leaf 38 and the second hinge leaf 39. FIG. 10 illustrates a rear perspective view showing the opening between the first panel 34, and the second panel 35. In FIG. 9, the portion of the suspended trolley assembly 30 hidden from view is illustrated in broken lines. The suspended trolley assembly 30 is darkened compared to the first panel 34 and the second panel 35 for ease of viewing. FIGS. 11-17 illustrate the suspended trolley assembly 30 in various views. FIG. 18 illustrates a side view of the suspended trolley assembly 30 showing its relation to the overhead guide track 37 and the second panel 35 with the hinge extension 31 outlined in dashed lines for ease of viewing. FIGS. 19 and 20 illustrate a top plan view of the suspended trolley assembly 30, first panel 34, second panel 35, and overhead guide track 37, with the overhead guide track 37 simplified and outlined with broken lines for ease of viewing. In FIG. 19, the first panel 34 and the second panel 35 are in the extended or closed. In FIG. 20, the first panel 34 and the second panel 35 are folded.

Figure 11:
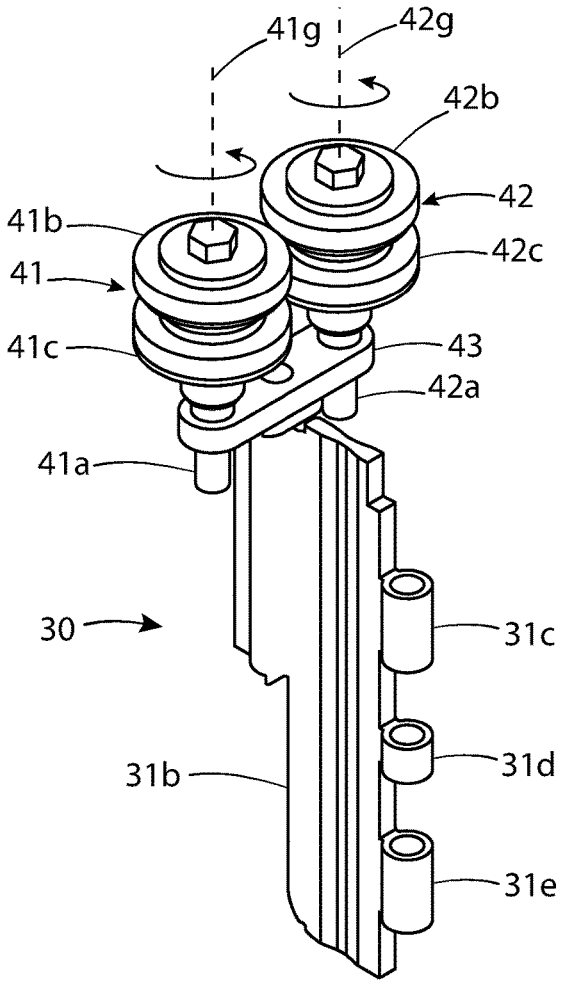
FIG. 11 illustrates a front perspective view of the suspended trolley assembly.
Figure 12:
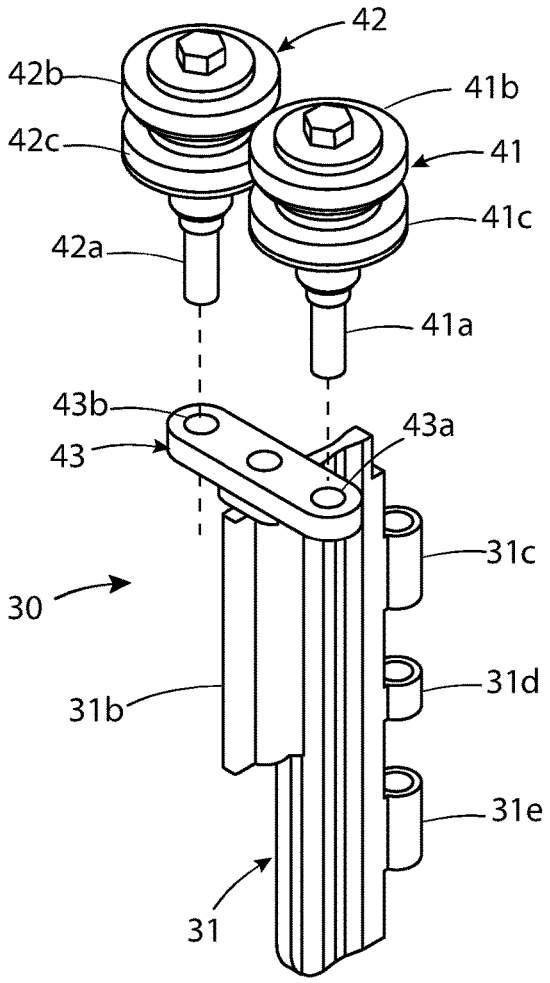
FIG. 12 illustrates an exploded front perspective view of the suspended trolley assembly of FIG. 11.
Figure 13:
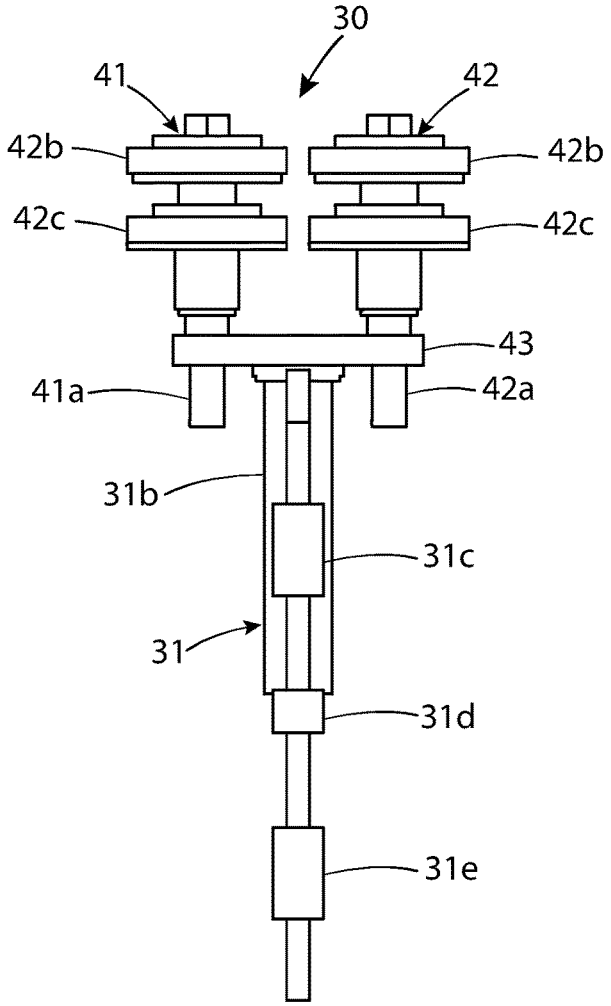
FIG. 13 illustrates a front elevation view of the suspended trolley assembly of FIG. 11.
Figure 14:
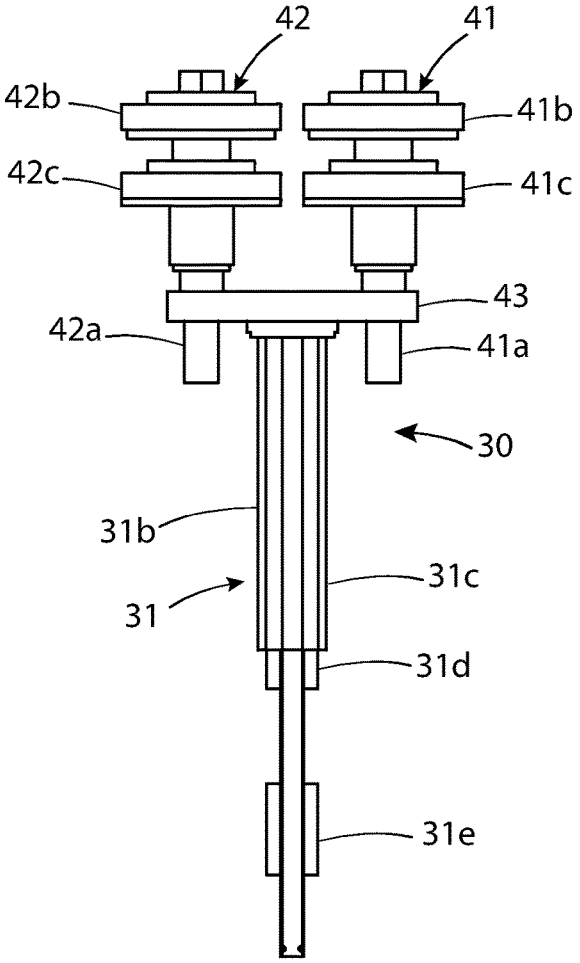
FIG. 14 illustrates a rear elevation view of the suspended trolley assembly of FIG. 11.
Figure 15:
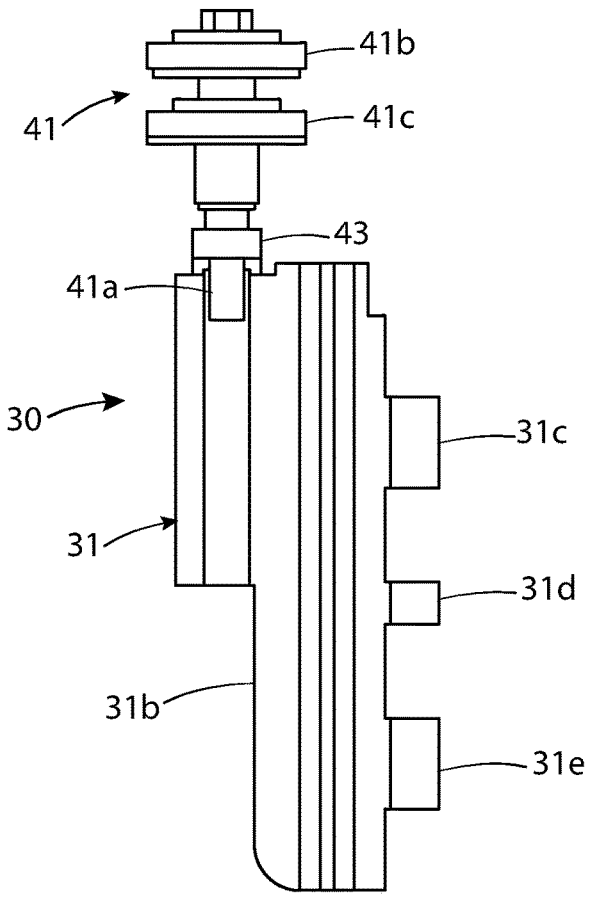
FIG. 15 illustrates a side elevation view of the suspended trolley assembly of FIG. 11

Referring to FIGS. 9-17, 19, and 20, the suspended trolley assembly 30 includes a first top-loaded dual roller assembly 41 and a second top-loaded dual roller assembly 42 spaced apart by a rigid guide member 43. Referring to FIGS. 9-15, and 17, the first top-loaded dual roller assembly 41 and the second top-loaded dual roller assembly 42 each are rotationally coupled to the rigid guide member 43 by a first vertical shaft 41*a* and a second vertical shaft 42*a* (the second vertical shaft 42*a* not shown in FIG. 15), respectively. Referring to FIG. 12, the first vertical shaft 41*a* and the second vertical shaft 42*a* is rotationally coupled to the rigid guide member 43 through apertures 43*a*, 43*b*, respectively. Referring to FIG. 11, the first top-loaded dual roller assembly is rotatable about a first vertical rotational axis 41*g* through the first vertical shaft 41*a*. The second top-loaded dual roller assembly is rotatable about a second vertical rotational axis 42*g* through the second vertical shaft 42*a*. The second rotational axis is spaced apart from the first vertical rotational axis 41*g*. The rigid guide member 43 is rigidly attached to the hinge extension 31.

Referring to FIGS. 6-8, and 18, the rigid guide member 43 is positioned below the overhead guide track 37. Referring to FIGS. 16 and 17, the rigid guide member lengthwise axis 43*c* is fixed at an angle A3 with respect to the hinge extension lengthwise axis 31*a*. The inventor found through testing of the system that an angle A3 of approximately 90° creates the best performance. Referring to FIGS. 9, and 11-15, the hinge extension 31 includes a hinge extension body 31*b* projecting downward and outward. At the end of the hinge extension 31 are hinge barrels 31*c*, 31*d*, 31*e*. Referring to FIG. 9, the hinge barrels 31*c*, 31*d*, 31*e* pivotably (i.e. hingedly) coupling the hinge extension 31 to the first hinge leaf 38 of the first panel 34 and the second hinge leaf 39 of the second panel 35 via a hinge pin 29 or other hinge joining mechanism.

Referring to FIGS. 6-17, the first top-loaded dual roller assembly 41 a first pair of vertically stacked helical bearings and the second top-loaded dual roller assembly 42 (FIGS. 6-14, 16, and 17) comprise and a second pair of vertically stacked helical bearings. Referring to FIGS. 6-15, the first pair of vertically stacked helical bearings include a first upper helical bearing 41*b* and a first lower helical bearing 41*c*. The second pair of vertically stacked helical bearings comprise a second upper helical bearing 42*b* (FIGS. 6-14) and a second lower helical bearing 42*c* (FIGS. 6-14). Referring to FIGS. 6-8, the first upper helical bearings 41*b*, the first lower helical bearing 41*c*, the second upper helical bearing 42*b*, and the second lower helical bearings 42*c* are suspended within the overhead guide track 37. In FIG. 6, they are suspended within the first linear track segment 32. In FIG. 8, they are suspended in second linear track segment 33. In FIG. 7, the first upper helical bearing 41*b* and the first lower helical bearing 41*c* of the first top-loaded dual roller assembly 41 are suspended in the second linear track segment 33 and the second upper helical bearing 42*b* and the second lower helical bearing 42*c* of the are suspended in first linear track segment 32.

FIG. 18, illustrates in more detail how the first top-loaded dual roller assembly 41 is suspended in the second linear track segment 33 of the overhead guide track 37. The same description also applies to the second top-loaded dual roller assembly 42. The first upper helical bearing 41*b* includes a lower surface 41*d*. The first lower helical bearing 41*c* includes a lower surface 41*e*. Both of the lower surfaces 41*d*,

41*e* are tapered downward. The second linear track segment 33 includes first projection 33*a*, second projection 33*b*, third projection 33*c*, and fourth projection 33*d* projecting inward and are tapered downward toward the center of the second linear track segment 33. The first projection 33*a*, second projection 33*b*, third projection 33*c*, fourth projection 33*d*, lower surfaces 41*d*, 41*e* are tapered so that the first upper helical bearing 41*b* and the first lower helical bearing 41*c* rest on opposing inside surfaces of the second linear track segment 33. The lower surface 41*e* of the first lower helical bearing 41*c* rests on the third projection 33*c* while the lower surface 41*d* of the first upper helical bearing 41*b* rests on the first projection 33*a*. The first upper helical bearing 41*b* and the first lower helical bearing 41*c* are disposed to rotate in opposite directions. This arrangement causes the suspended trolley assembly 30 to self-center. As the suspended trolley assembly 30 shifts to one side or the other, the downward taper of the first projection 33*a*, the second projection 33*b*, the third projection 33*c*, and the fourth projection 33*d* in combination with the inward taper of the lower surface 41*d* of the first upper helical bearing 41*b* and the lower surface 41*e* of the first lower helical bearing 41*c* will cause the suspended trolley assembly 30 to re-center itself. In addition, the alignment bearing 41*f* is tightly coupled to the inside surface of the throat 33*e* of the second linear track segment 33, and this limits the extent of the movement of the first upper helical bearing 41*b* and the first lower helical bearing 41*c* from side to side.

Referring to FIGS. 6-8, and 18, the rigid guide member 43 is positioned outside and below the overhead guide track 37 and shown positioned above the top rail 35*a* of the second panel 35. The positioning of the rigid guide member 43 below the overhead guide track 37, in combination with other factors previously described allow the suspended trolley assembly 30 to traverse a segmented track and do so with stability. The other factors include rigidly spacing apart of the first top-loaded dual roller assembly 41 and the second top-loaded dual roller assembly 42 by the rigid guide member 43 lengthwise along the overhead guide track 37 and the rigidly extending away the hinge extension 31 so it maintains a fixed angle with respect to the overhead guide track 37 except at the junction between the overhead linear track segments. Referring to FIGS. 6-8, 19, and 20, the hinge extension 31 being positioned between the first panel 34 and the second panel 35, in combination with the fixed angle between the hinge extension 31 and the rigid guide member 43 allows the door assembly 40 move along the overhead guide track 37 and between the first linear track segments 32 and the second linear track segment 33 independent of whether or not the door is folded or unfolded.

Referring to FIGS. 19 and 20, the suspended trolley assembly 30 is mounted between the first panel 34 and the second panel 35. The first panel 34 includes a first glazing panel 34*b*. The second panel 35 includes a second glazing panel 35*b*. The first glazing panel 34*b* and the second glazing panel 35*b* are illustrated as integrated glass units, also known as IGUs, but can also include other infill material use as single pane glass, polycarbonate, or acrylic. Alternatively, other infills such as aluminum can be substituted for first glazing panel 34*b* and the second glazing panel 35*b*. A first hinge leaf 38 is secured to the first panel 34. A second hinge leaf 39 is secured to the second panel 35. The first hinge leaf 38 and the second hinge leaf 39 each pivotably (i.e., hingedly) engage the suspended trolley assembly 30 via the hinge extension 31. Referring to FIG. 9, the first hinge leaf 38 and the second hinge leaf 39 pivotably engage the hinge barrels 31*c*, 31*d*, 31*e* of the hinge extension 31. Referring to FIGS. 19 and 20, the first hinge leaf 38 can be secured to the inside face of the suspended panel, for example, by a threaded fastener 44. The second hinge leaf 39 can secure to the inside face of the second panel 35 by a threaded fastener 45. The threaded fasteners 44, 45 can be any threaded fasteners capable of securing and supporting the first panel 34 and second panel 35 under normal operation.

Figure 21:
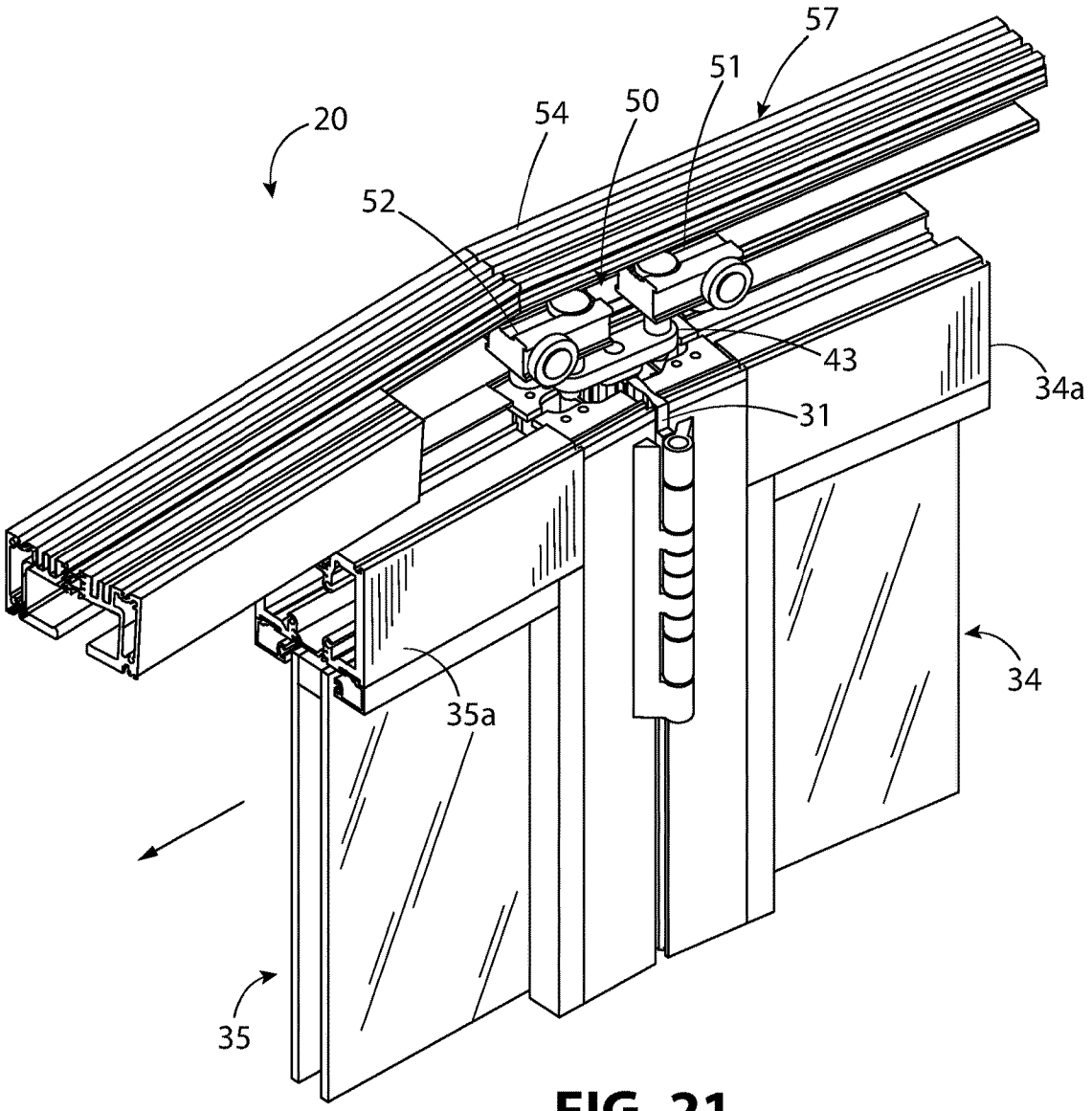
FIG. 21 illustrates an alternative embodiment of a suspended trolley assembly, suspended folding panels, and overhead guide track assembly of the present disclosure, in front perspective view, with the overhead guide track partially cutaway to show the trolley positioned to left of the linear track segment.
Figure 22:
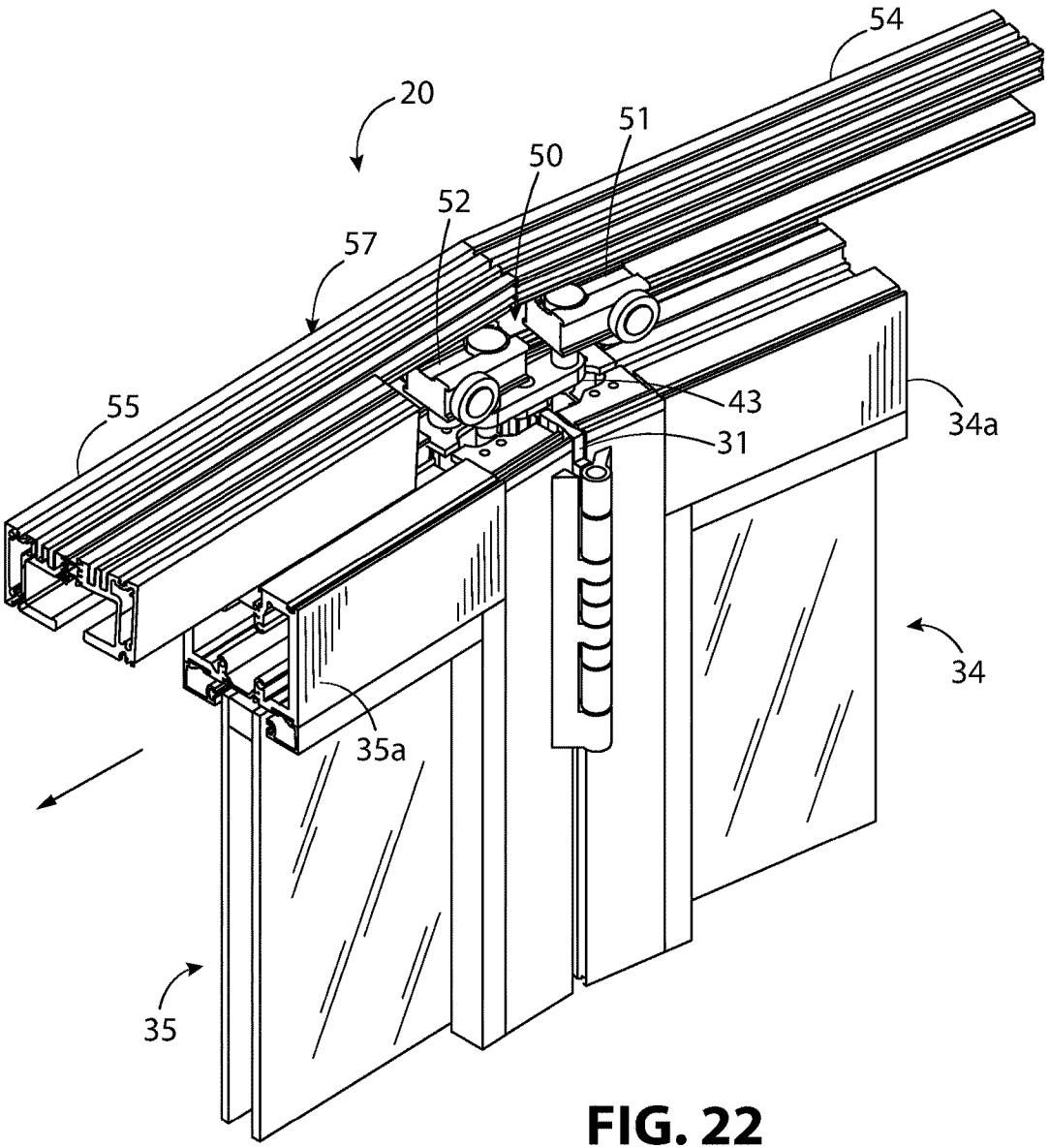
FIG. 22 illustrates the alternative embodiment of the suspended trolley assembly, suspended folding panels, and overhead guide track assembly of the present disclosure in front perspective view, with the overhead guide track partially cutaway to show the trolley positioned at the linear track segment.
Figure 23:
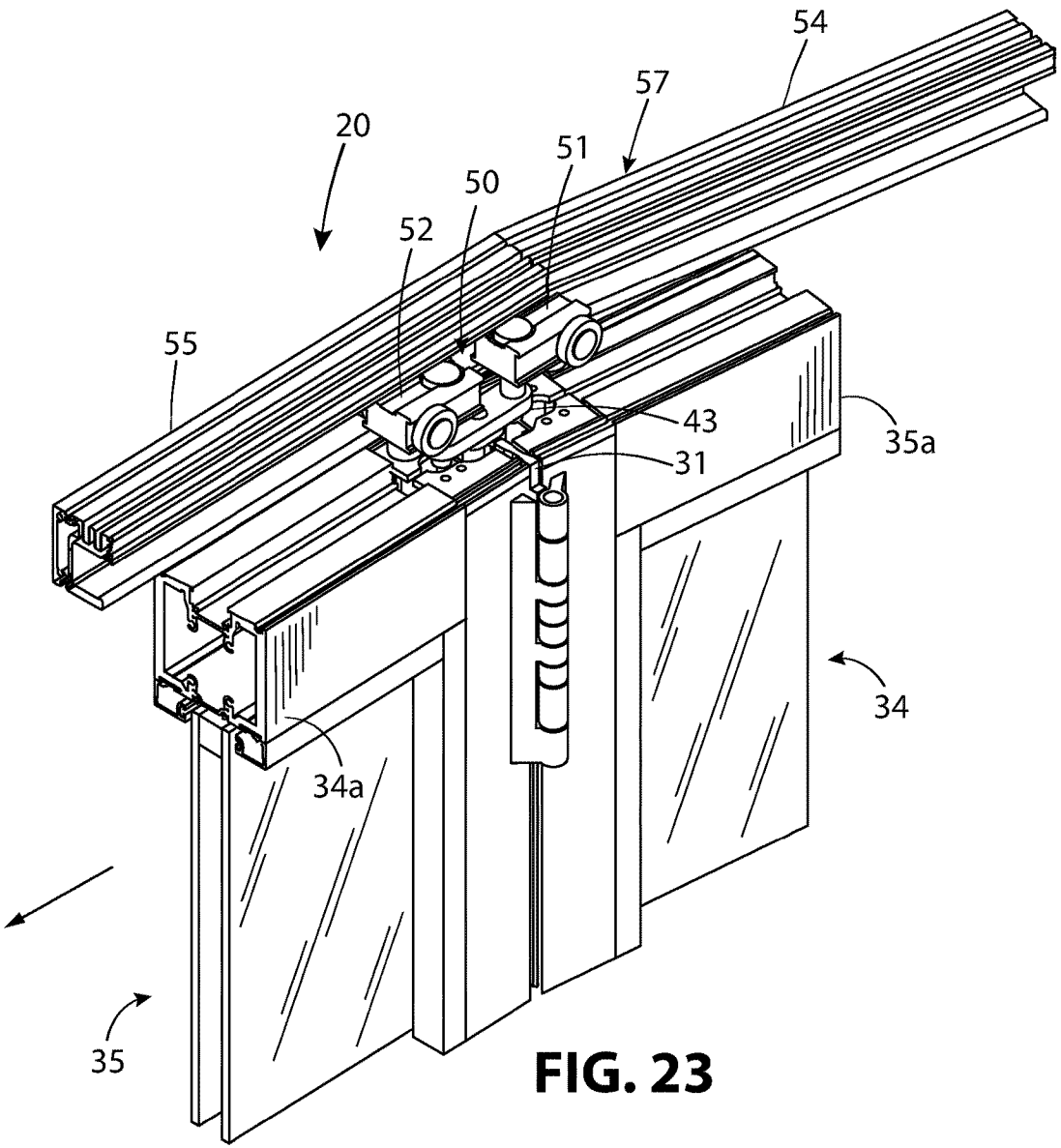
FIG. 23 illustrates the alternative embodiment of the suspended trolley assembly, suspended folding panels, and overhead guide track assembly of the present disclosure in front perspective view, with the overhead guide track partially cutaway to show the trolley positioned to the right of the linear track segment.
Figure 24:
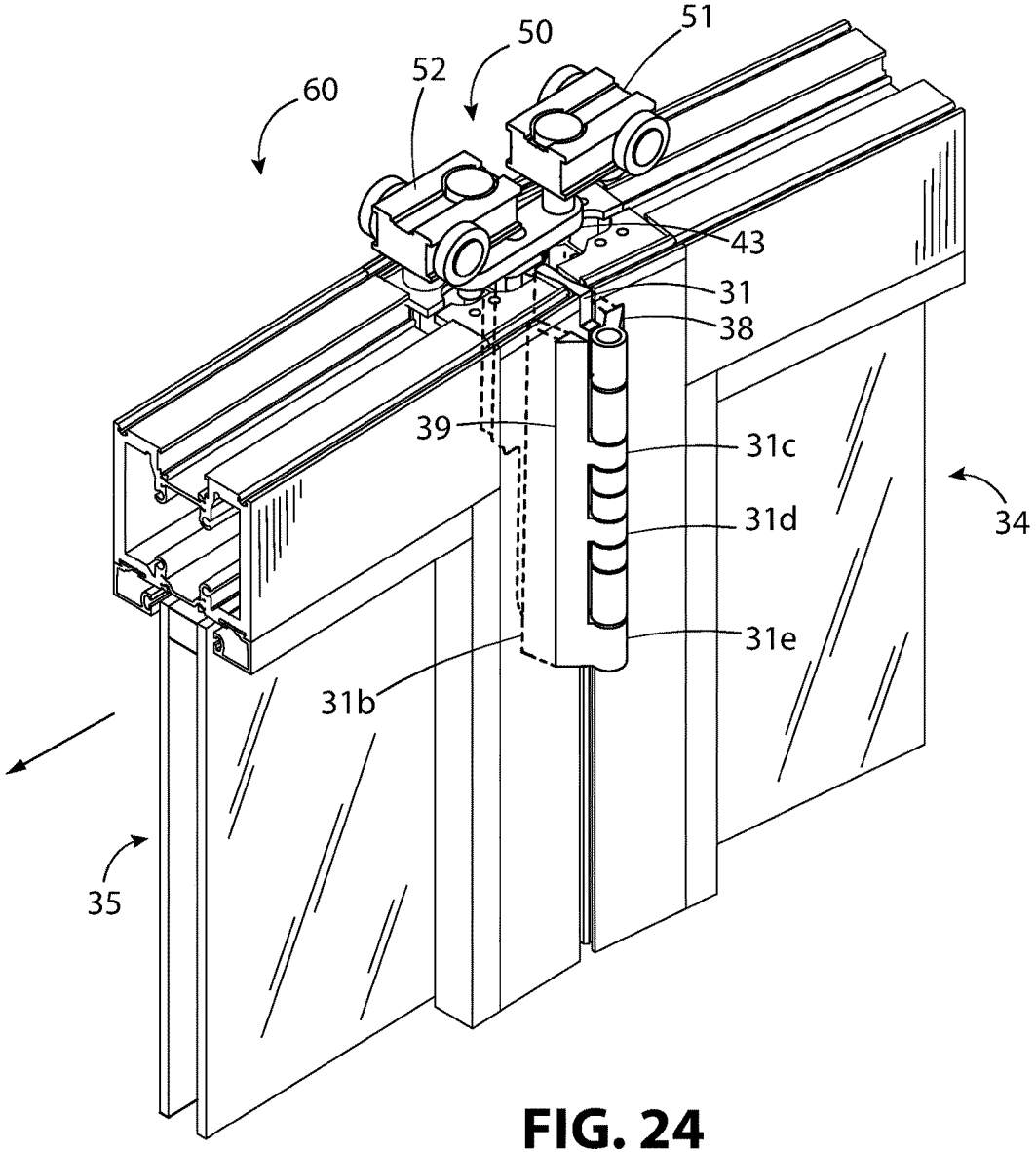
FIG. 24 illustrates the suspended trolley assembly and suspended folding panels of FIG. 23 in front perspective view with portions of the suspended trolley assembly hidden from view illustrated with broken lines.
Figure 25:
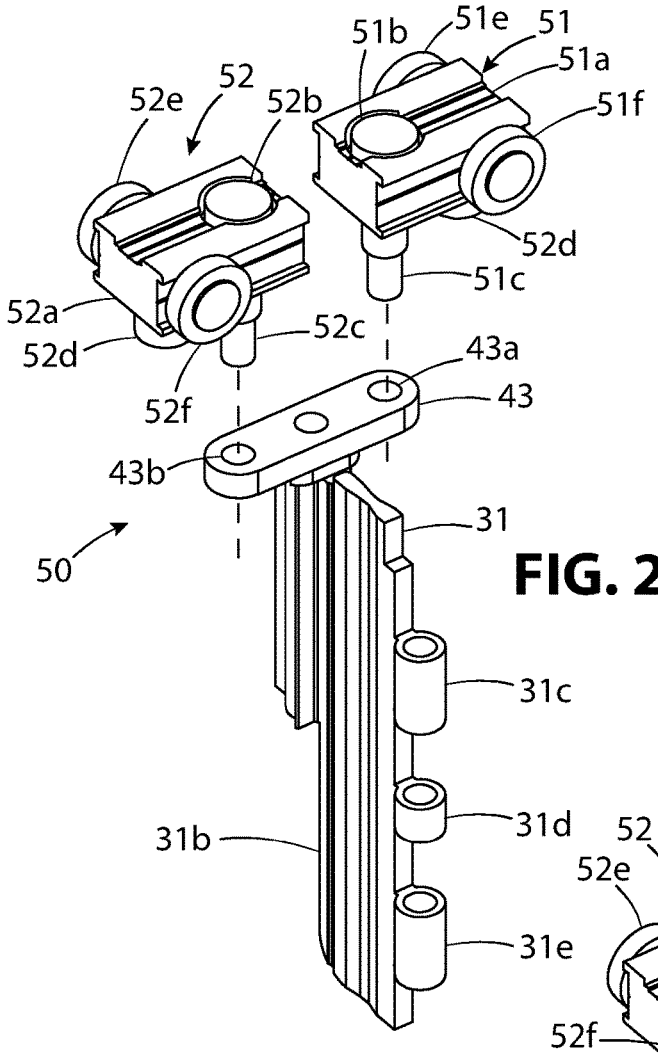
FIG. 25 illustrates an exploded front perspective view of the alternative embodiment of the suspended trolley assembly.
Figure 26:
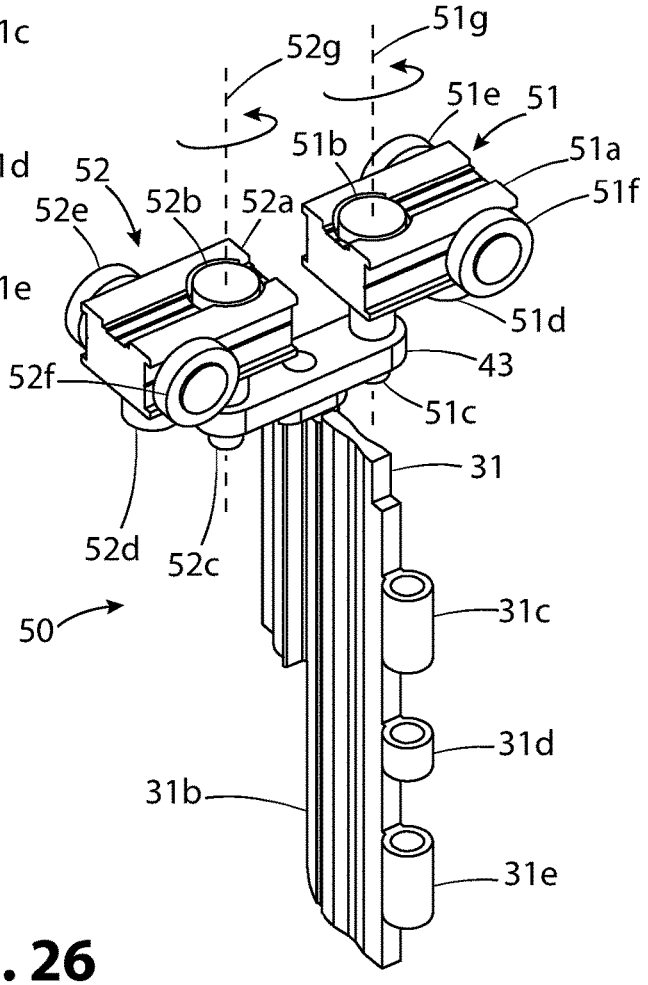
FIG. 26 illustrates a front perspective view of the alternative embodiment of the suspended trolley assembly of FIG. 25.
Figure 27:
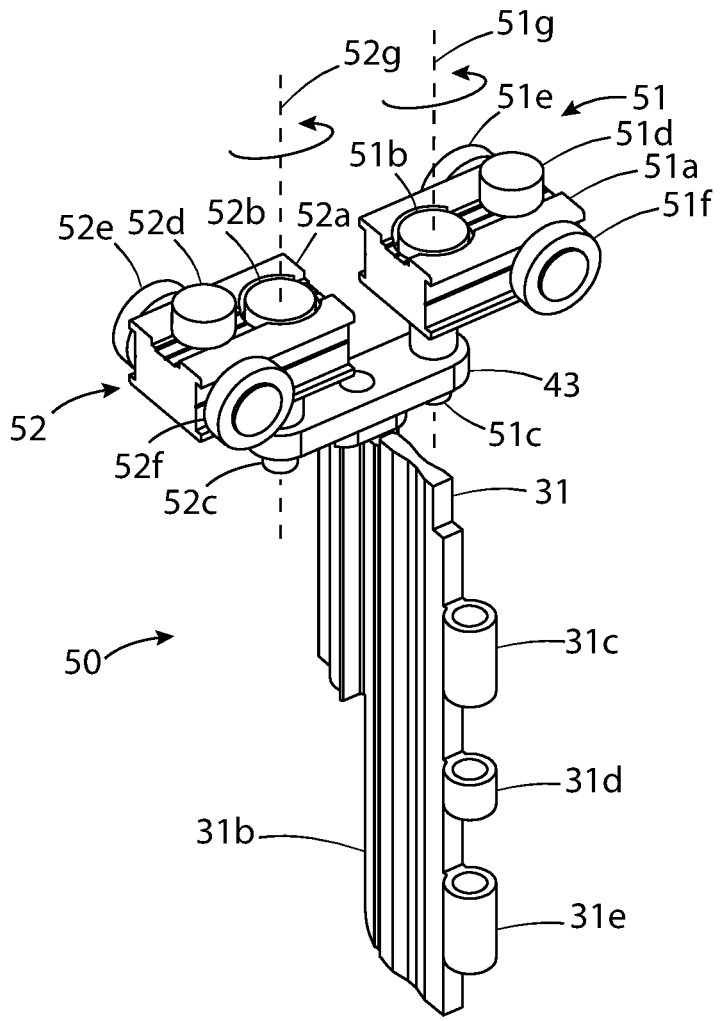
FIG. 27 illustrates a front perspective view of the suspended trolley assembly of FIG. 25 where the first horizontal roller is optionally positioned on the top of the first body and the second horizontal roller is optionally positioned on the top of the second body.
Figure 28:
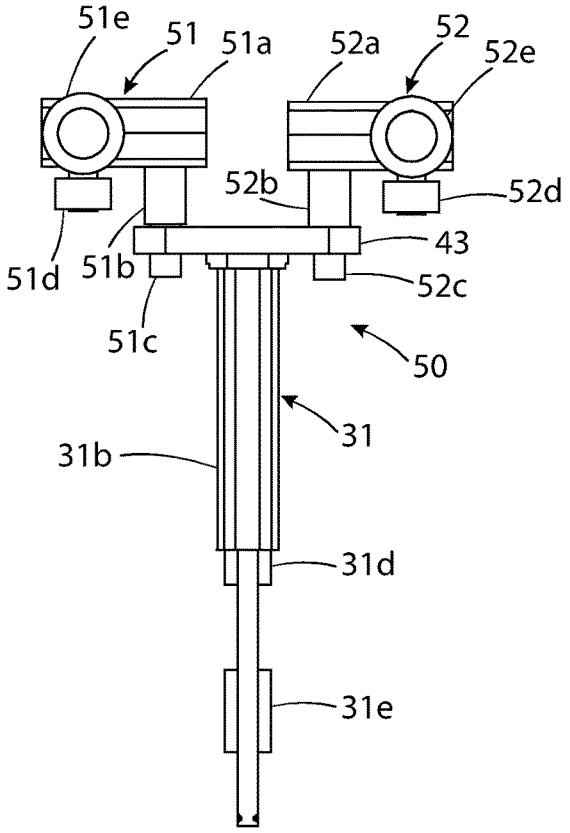
FIG. 28 illustrates a front elevation view of the suspended trolley assembly of FIG. 25.
Figure 29:
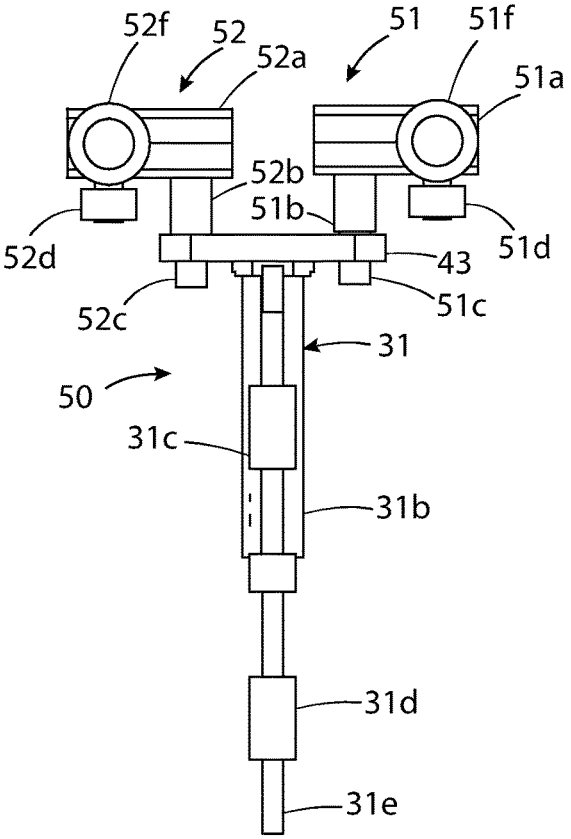
FIG. 29 illustrates a rear elevation view of the suspended trolley assembly of FIG. 25.

FIGS. 21-32 illustrate a second embodiment of the suspended trolley assembly 50. The first top-loaded dual roller assembly 51 and the second top-loaded dual roller assembly 52 each include vertically-wheeled horizontal trolleys rather than vertically stacked helical bearings of FIGS. 6-20. FIGS. 21-23 illustrate a portion of the second embodiment of the suspended folding panel system 20 including the suspended trolley assembly 50, first panel 34, second panel 35, and overhead guide track 57, in front perspective view. Portions of the front of the overhead guide track 57 are either partially or fully cutaway to show the suspended trolley assembly 50. In FIG. 21, the suspended trolley assembly 50 is suspended by overhead linear track segments 54. In FIG. 22, the suspended trolley assembly 50 is suspended by both overhead linear track segments 54, 55. In FIG. 23, the suspended trolley assembly 50 is suspended by overhead linear track segment 55. FIG. 24 illustrates a portion of the door assembly 60 including the suspended trolley assembly 50, the first panel 34, the second panel 35, and overhead guide track 57 of FIG. 23 in front perspective view with portions of the suspended trolley assembly 50 hidden from view illustrated with broken lines. FIGS. 25-32 illustrate the suspended trolley assembly 50 in various views. FIGS. 25-30, and 32 illustrate the first horizontal roller 51*d* optionally positioned below the first body 51*a* and the second horizontal roller 52*d* optionally positioned below the second body 52*a*. FIG. 27 illustrates alterative placement of the first horizontal roller 51*d* and the second horizontal roller 52*d* positioned optionally on top of the first body 51*a* and the second body 52*a*, respectively.

Figure 30:
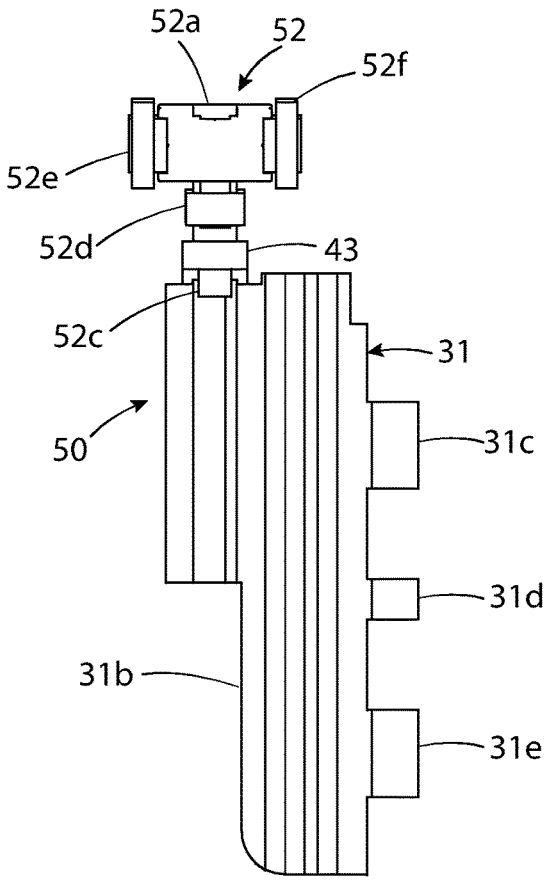
FIG. 30 illustrates a side elevation view of the suspended trolley assembly of FIG. 25.
Figure 31:
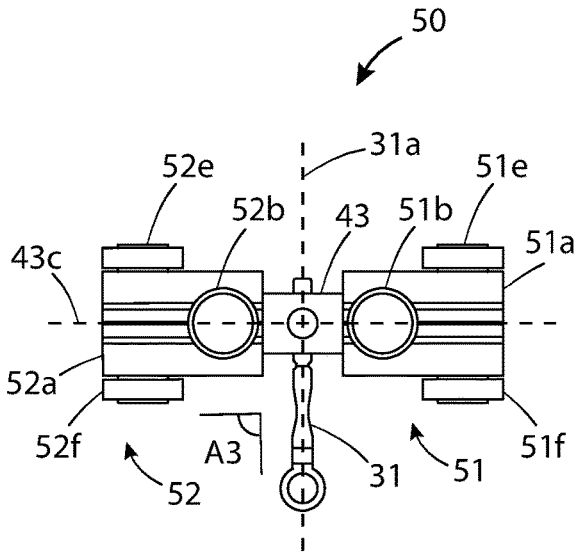
FIG. 31 illustrates a top view of the suspended trolley assembly of FIG. 25.

The suspended trolley assembly 50 of FIGS. 21-32 shares structural similarities with the suspended trolley assembly 30 of FIG. 6-20. A combination of these structural similarities allows the suspended trolley assembly 50 to traverse a segmented track and do so with stability. Referring to FIGS. 21-32, first, the suspended trolley assembly 50 includes a first top-loaded dual roller assembly 51 and a second top-loaded dual roller assembly 52 rigidly spaced apart by a rigid guide member 43. Referring to FIGS. 21-23, second, the rigid guide member 43 is positioned outside and below the overhead guide track 57 and shown positioned above the top rails 34*a*, 35*a* of the first panel 34 and the second panel 35, respectively. Referring to FIGS. 21-32, third, the rigid guide member 43 is rigidly attached to the hinge extension 31. Referring to FIGS. 30 and 31, the rigid guide member lengthwise axis 43*c* is fixed at an angle A3 with respect to the hinge extension lengthwise axis 31*a*. As with the first embodiment, the inventor believes that angle A3 of approximately 90° creates the best performance. Referring to FIG. 21-23, fourth, the hinge extension 31 being positioned between the first panel 34 and the second panel 35, in combination with the fixed angle between the hinge extension 31 and the rigid guide member 43 allows the door assembly 60 of FIG. 24, to move along the overhead guide track 37 and between the first linear track segment 32 and the second linear track segment 33 independent of whether or not the door is folded or unfolded.

Referring to FIGS. 25-32, and reviewing the suspended trolley assembly 50 in more detail, the first top-loaded dual roller assembly 51 includes a first body 51*a*, a first vertical bearing 51*b*, a first vertical shaft 51*c*, and optionally, a first horizontal roller 51*d*. The second top-loaded dual roller assembly 52 includes a second body 52*a*, a second vertical bearing 52*b*, a second vertical shaft 52*c*, and optionally, a second horizontal roller 52*d*. The first vertical bearing 51*b* is rotationally coupled to a first vertical shaft 51*c*. The second vertical bearing 52*b* is rotationally coupled to a second vertical shaft 52*c*. The first vertical bearing 51*b* and the second vertical bearing 52*b* can alternatively be coupled to the rigid guide member 43 instead of the first body 51*a* or the second body 52*a*.

Figure 32:
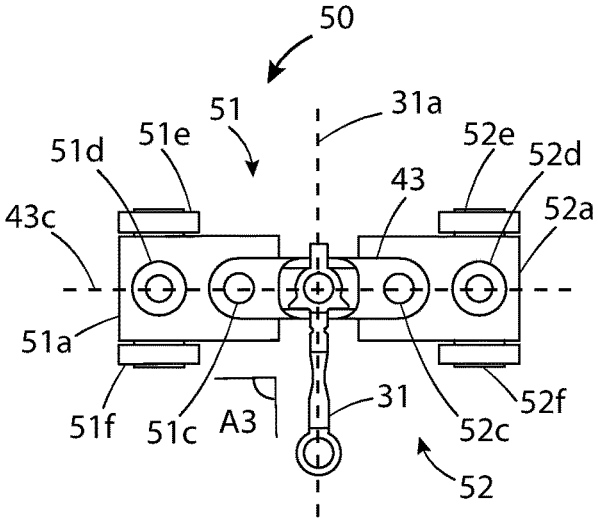
FIG. 32 illustrates a bottom view of the suspended trolley assembly of FIG. 25.
Figure 33:
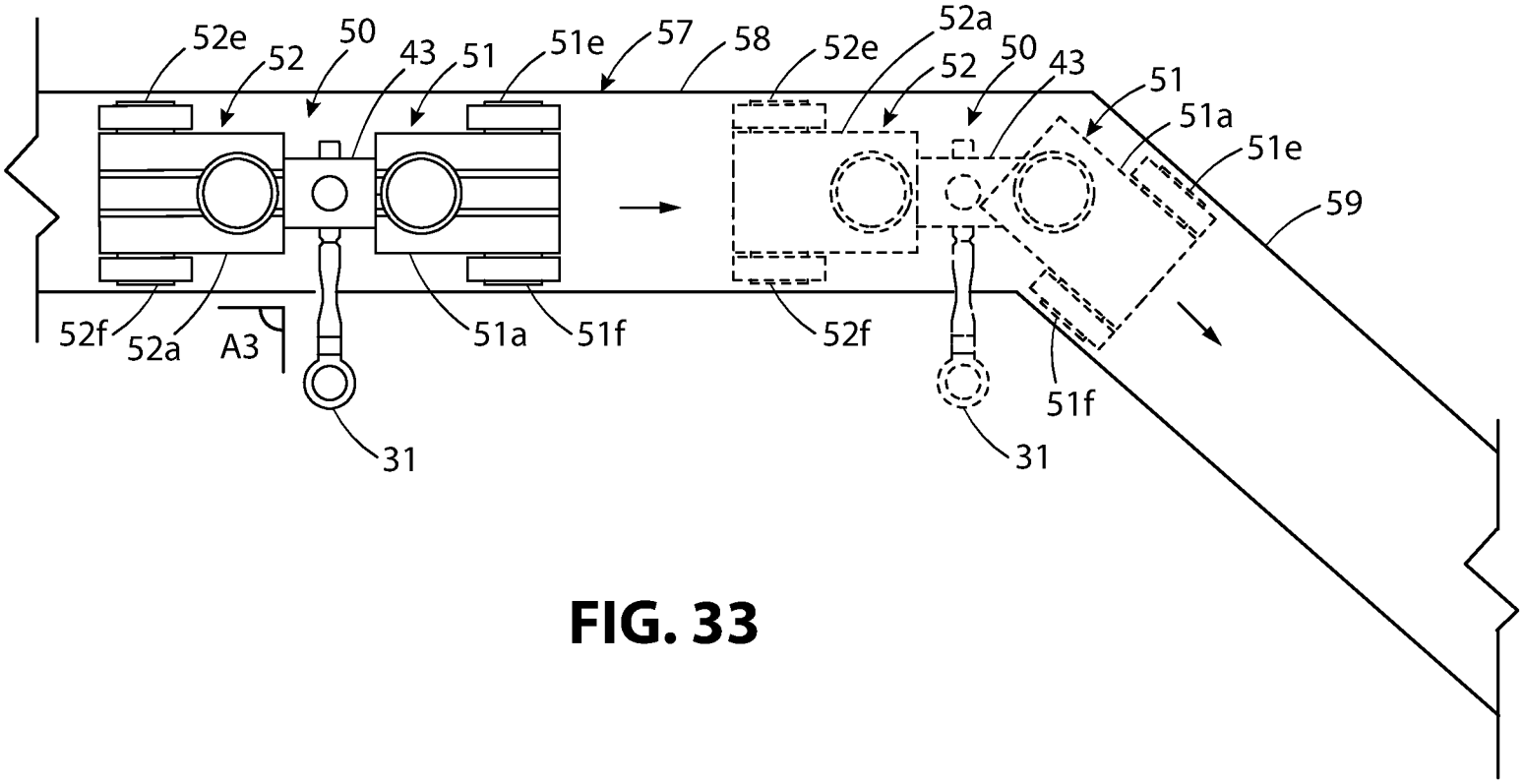
FIG. 33 illustrates the suspended trolley assembly of FIG. 25 moving through the junction of an overhead guide track.

A first vertical roller 51*e* and a second vertical roller 51*f* are rotationally coupled to the first body 51*a* on opposite sides of the first body 51*a*. A third vertical roller 52*e* and a fourth vertical roller 52*f* are rotationally coupled to the second body 52*a* on opposite sides of the second body 52*a*. The second vertical roller 51*f* and the fourth vertical roller 52*f* are hidden from view in FIG. 28. The first vertical roller 51*e* and third vertical roller 52*e* are hidden from view in FIG. 29. The first body 51*a*, the first vertical roller 51*e*, the second vertical roller 51*f*, and the first horizontal roller 51*d* are hidden from view in FIG. 30. The first horizontal roller 51*d* and the second horizontal roller 52*d* are hidden from view in FIG. 31. The first vertical bearing 51*b* and the second vertical bearing 52*b* are hidden from view in FIG. 32. Referring to FIG. 33, the first vertical roller 51*e* and the second vertical roller 51*f* suspend and move the first body 51*a* lengthwise along the overhead guide track 57. Referring to FIGS. 26 and 32, the first top-loaded dual roller assembly 51 and the second top-loaded dual roller assembly 52 are rotationally coupled to the rigid guide member 43 by the first vertical shaft 51*c* (FIG. 26) and the second vertical shaft 52*c* (FIG. 26). Referring to FIG. 25, the first vertical shaft 51*c* and the second vertical shaft 52*c* are spaced apart by rigid guide member 43 through apertures 43*a*, 43*b*, respectively. Referring to FIGS. 25-30, the hinge extension 31 includes a hinge extension body 31*b* projecting downward and outward. At the end of the hinge extension 31 are hinge barrels 31*c*, 31*d*, 31*e* for pivotably (i.e. hingedly) coupling the hinge extension 31. Referring to FIG. 24, the hinge barrels 31*c*, 31*d*, 31*e* extending from the hinge extension body 31*b* pivotably engage the first hinge leaf 38 of the first panel 34 and to the second hinge leaf 39 of the second panel 35.

Referring to FIGS. 26 and 27, the first top-loaded dual roller assembly 51 and the second top-loaded dual roller assembly 52 have a rotational degree of freedom about a first vertical rotational axis 51*g* and second vertical rotation axis 52*g*, respectively. Referring to FIG. 33, the first top-loaded dual roller assembly 51 and the second top-loaded dual roller assembly 52 also have linear degree of freedom in a horizontal plane. Referring to FIGS. 21-23 and 33, in addition, the first top-loaded dual roller assembly 51 and the second top-loaded dual roller assembly 52 are rigidly coupled together to both the rigid guide member 43 and the hinge extension 31, with the hinge extension, positioned outside and below the overhead guide track 57. This combination, allows the suspended trolley assembly 30 and the first panel 34 (FIGS. 21-23) and the second panel 35 (FIGS. 21-23) to move smoothly and stably through while transitioning at the junction of segment tracks. Referring to FIG. 33, while the suspended trolley assembly is fully within overhead linear track segment 58, the first vertical roller 51*e*, second vertical roller 51*f*, third vertical roller 52*e*, and fourth vertical roller 52*f* move the suspended trolley assembly 50 linearly along the lengthwise axis of overhead linear track segment 58. Note that in some applications, it may be possible to eliminate one vertical roller from each top-loaded dual roller assembly, for example second vertical roller 51*f* and fourth vertical roller 52*f*, and rely on the remaining vertical rollers and the first horizontal roller 51*d* and the second horizontal roller 52*d*.

The angle between the overhead linear track segment 58 and the hinge extension 31 remains fixed at angle A3. Here shown as 90°. As the suspended trolley assembly 50 transitions from the overhead linear track segment 58 to the overhead linear track segment 59, the second body 52*a* of the second top-loaded dual roller assembly 52 rotates about the axis of the first vertical shaft 51*c* (hidden from view) and the first vertical bearing 51*b*. Once the second top-loaded dual roller assembly engages the overhead linear track segment 59 the first body 51*a* and the second body 52*a* will move linearly along the overhead linear track segment 59. The hinge extension 31 will be at a fixed angle A3 with respect to the overhead linear track segment 59. As shown, A3 is approximately 90°.

Figure 34:
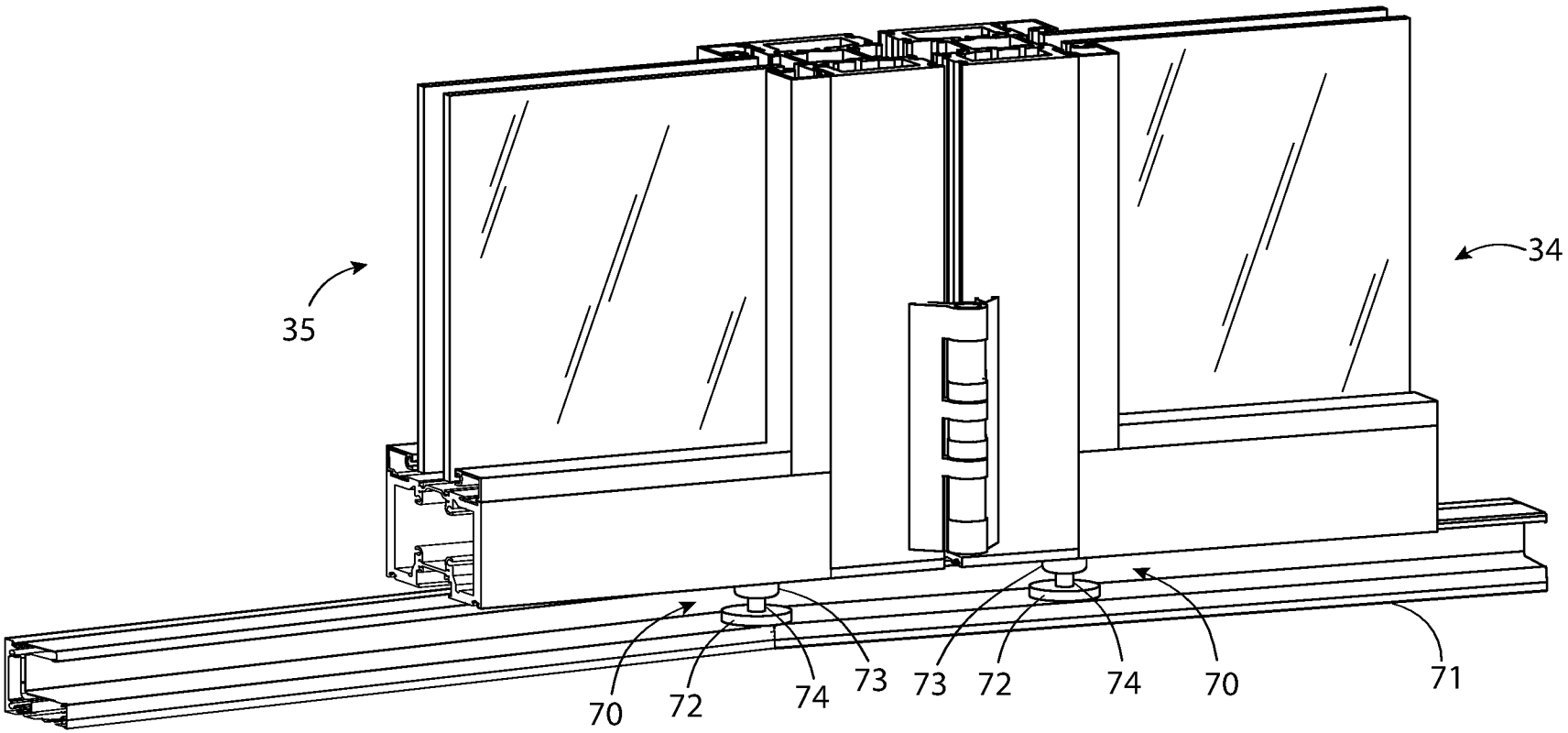
FIG. 34 illustrates a front perspective view of a pair of bottom roller guide assemblies, suspended panels, and sill guide track that can be used with the embodiments of the suspended trolley assembly, suspended folding panel, and overhead guide track of the present disclosure.
Figure 35:
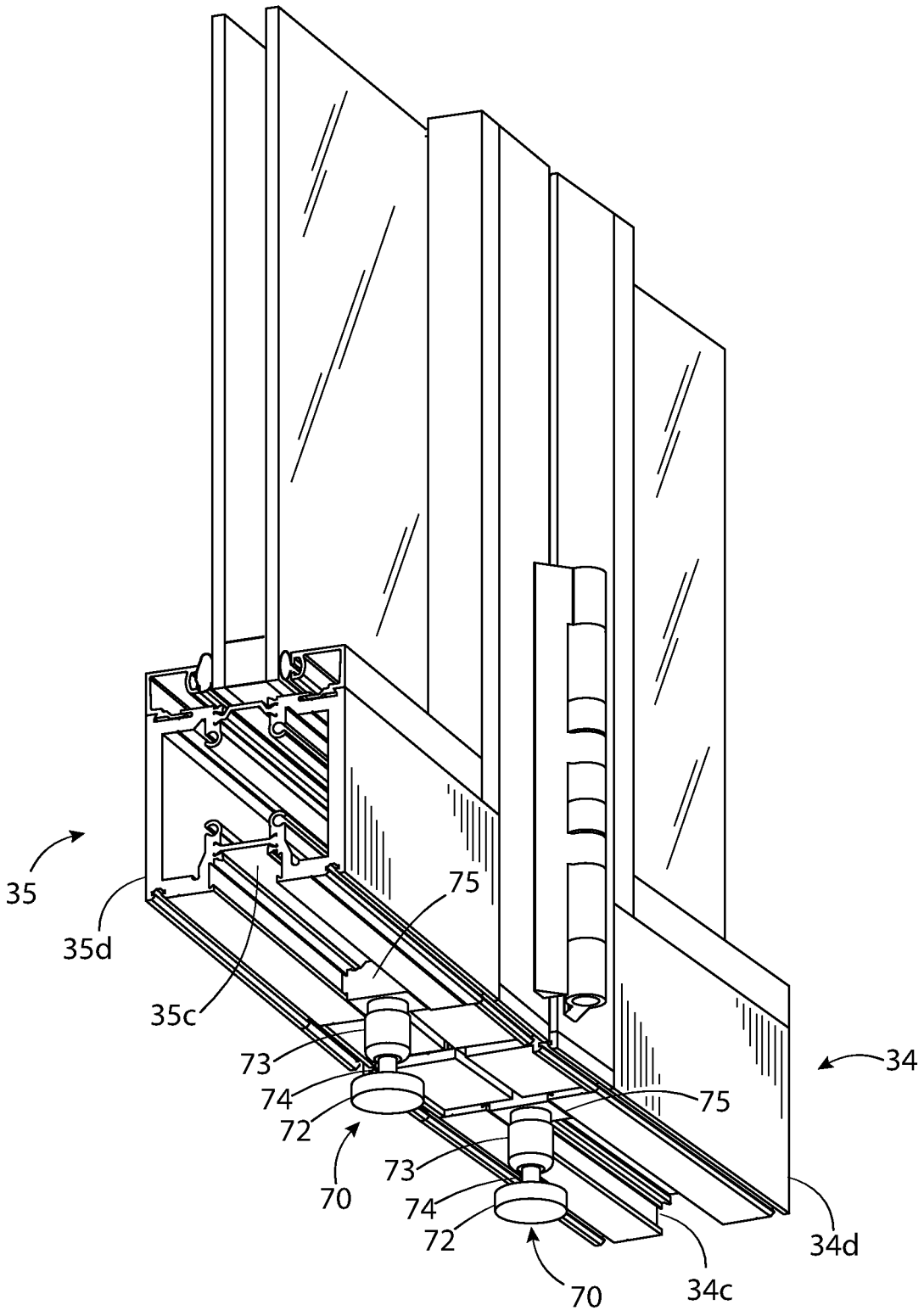
FIG. 35 illustrates a bottom perspective view of a pair of bottom roller guide assemblies and the suspended folding panels of FIG. 33.
Figure 36:
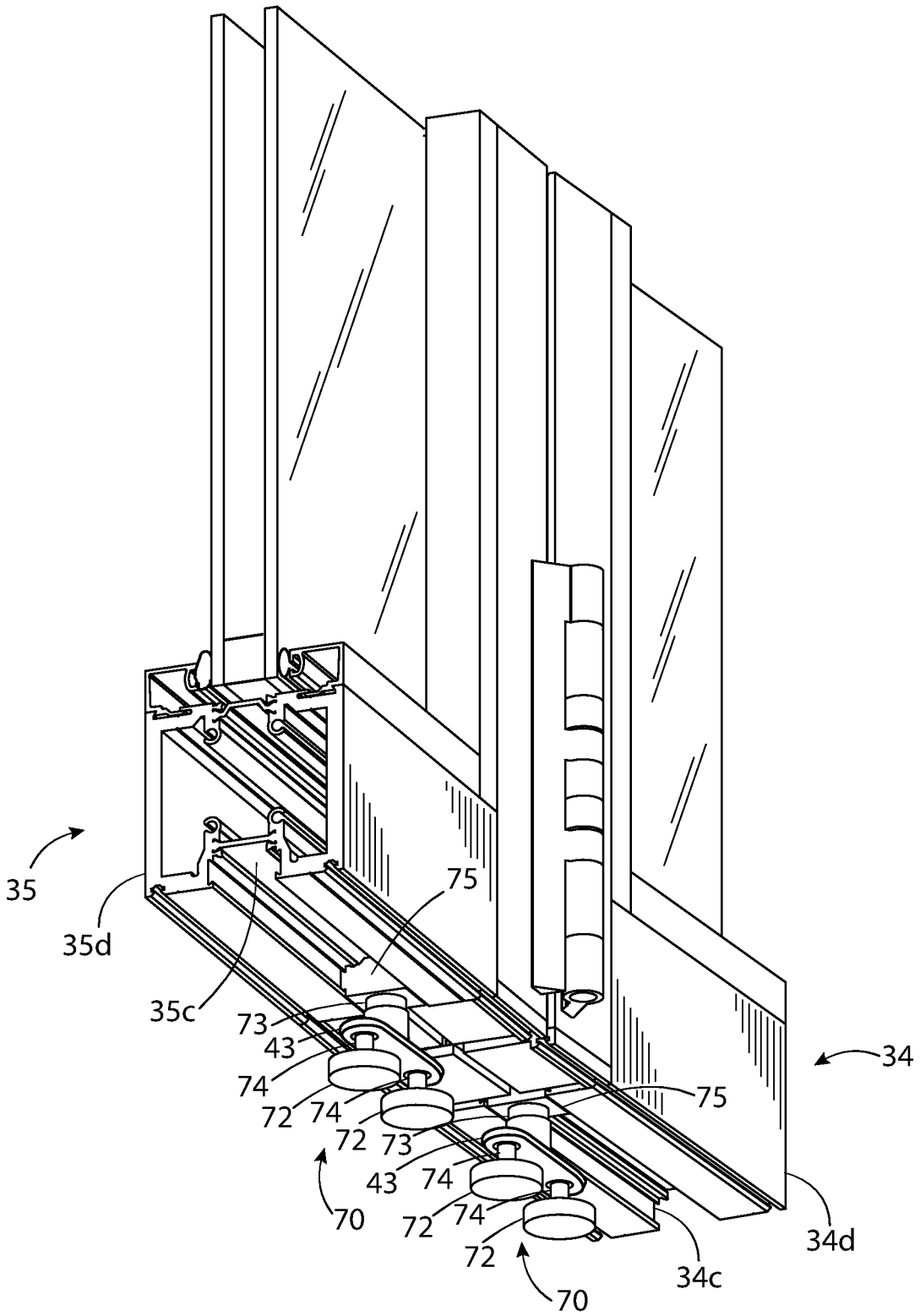
FIG. 36 illustrates a bottom perspective view of a pair of dual bottom roller guide assemblies and the suspended folding panels of FIG. 33.

The suspended trolley assembly 30 of FIGS. 6-20 and the suspended trolley assembly 50 of FIGS. 21-33 suspend the door assembly 40 (FIG. 9) and suspended the door assembly 60 (FIG. 24) by overhead guide tracks. Because all the weight is borne by the overhead guide track, the bottom of the door can be held within a sill track by simple roller guides or pins. For example, in FIG. 34 the bottom of the first panel 34 and the second panel 35 are guided within the sill track 71 by a pair of roller guide assemblies 70. Referring to FIGS. 34-36, each of the roller guide assemblies 70 illustrated includes a horizontal roller 72, a vertical bearing 73 and a vertical shaft 74. In FIG. 35, the vertical shaft 74 is coupled directly to the vertical bearing 73 to the horizontal roller 72. Referring to FIG. 36, in an alternatively arrangement, the vertical bearing 73 is coupled to a rigid guide member 43. A pair of the horizontal rollers 72 are spaced apart and coupled to the rigid guide member 43 via vertical shafts 74. This arrangement allows the horizontal rollers 72 that are spaced apart by the rigid guide member 43, to rotate about the vertical bearing 73. This arrangement allows the roller guide assemblies 70 to more easily navigate the transition between steep angled sill track segments then the arrangement of FIG. 35. Referring to FIGS. 35 and 36, the vertical bearing 73 is coupled to a base 75. The base 75 of one of the roller guide assemblies 70 is slidably captive and securable to slot 34*c* and oriented lengthwise along the bottom face of the bottom rail 34*d* of the first panel 34. The base 75 of other of the pair of roller guide assemblies 70 is slidably captive and securable to slot 35*c* oriented lengthwise along the bottom face of the bottom rail 35*d* of the second panel 35.

Figure 37:
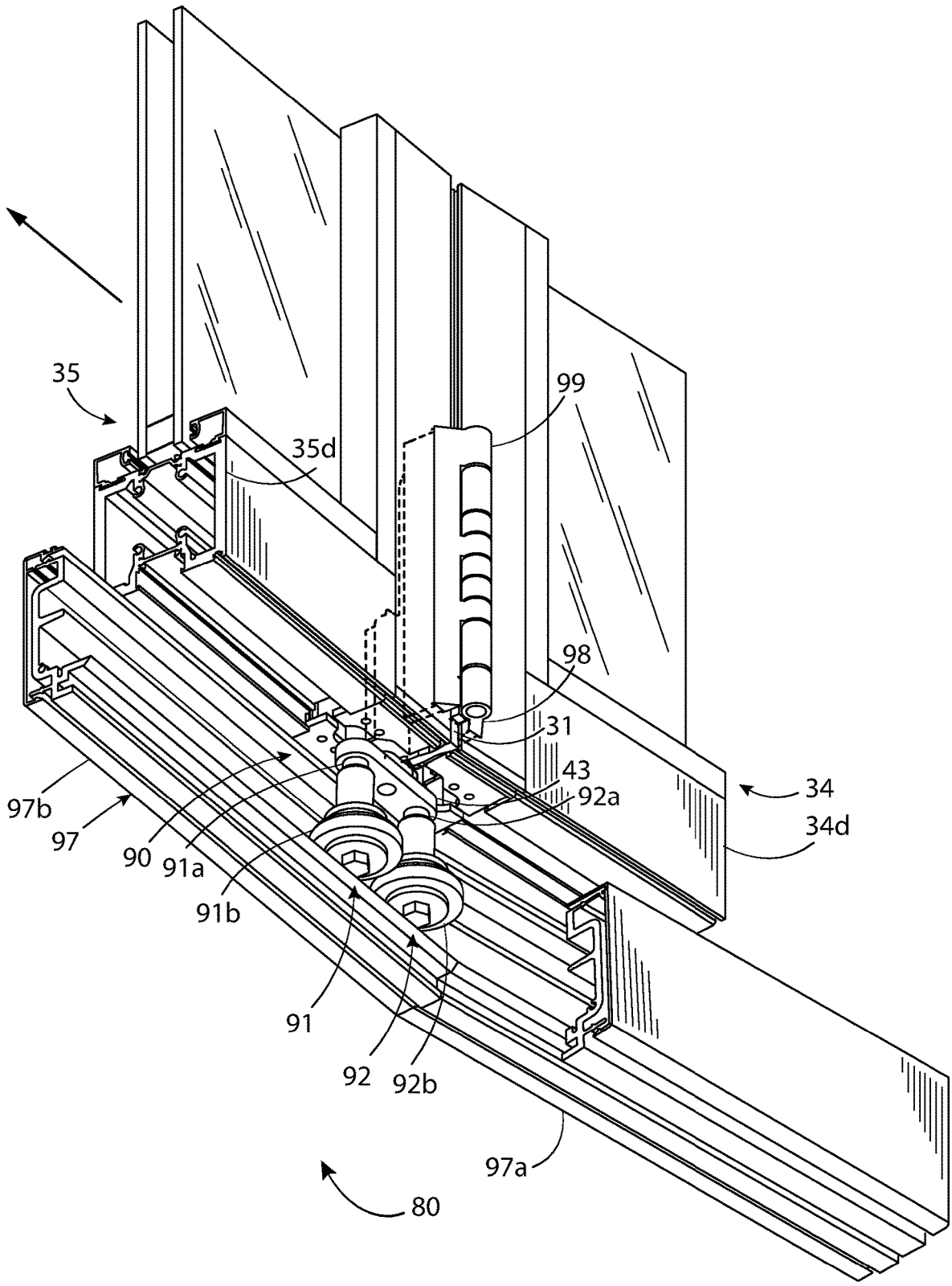
FIG. 37 illustrates a bottom perspective view of a bottom-loaded folding panel system of the present disclosure with a trolley assembly that utilizes a pair of single helical bearings.
Figure 38:
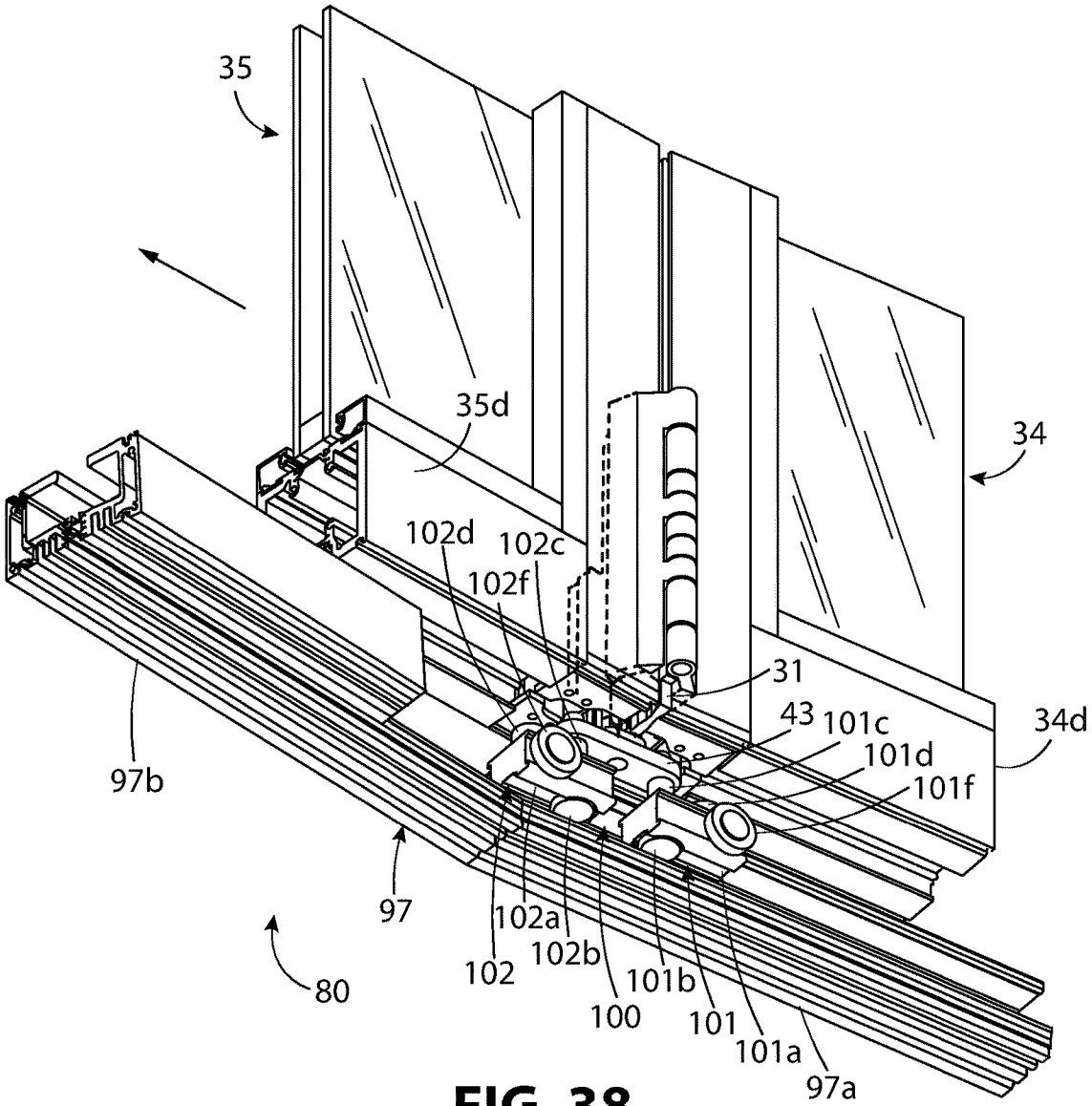
FIG. 38 illustrates a bottom perspective view of a bottom-loaded folding panel system of the present disclosure with a trolley assembly that utilizes a pair of bottom-loaded dual roller assemblies.

FIGS. 6-32 discussed various aspects of suspended folding panel system 20. The inventor found that he could apply some of the unique principles and structure to a bottom-loaded folding panel system. Two examples of bottom-loaded folding panel systems 80 embodying these principles are illustrated in FIGS. 37 and 38, respectively. FIG. 37 illustrates the bottom-loaded folding panel system 80 with a bottom-loaded trolley assembly 90 utilizing helical bearings. FIG. 38 illustrates the bottom-loaded folding panel system 80 with a bottom-loaded trolley assembly 100 similar to the top-loaded trolley assembly of FIG. 21-31.

Referring to FIG. 37, the bottom-loaded trolley assembly 90 is constructed similarly to the top-loaded trolley assembly of FIGS. 6-17 except the first bottom-loaded roller assembly 91 and the second bottom-loaded roller assembly 92 each are shown utilizing single helical bearings instead of dual helical bearings. The inventor found, that while stacked helical bearings could be used, they are not necessary for bottom-loaded systems. The bottom-loaded trolley assembly 90 includes a rigid guide member 43 positioned outside and above the sill track 97, a first bottom-loaded roller assembly 91 and the second bottom-loaded roller assembly 92 spaced apart by the rigid guide member 43 and supported within the sill track 97. The rigid guide member 43 is shown positioned above the bottom rails 34*d*, 35*d* of the first panel 34 and the second panel 35, respectively. The first bottom-loaded roller assembly 91 includes first helical bearing 91*b* extending from the first vertical shaft 91*a*. The second bottom-loaded roller assembly 92 includes a second helical bearing 92*b* extending from the second vertical shaft 92*a*. The first vertical shaft 91*a* and the second vertical shaft 92*a* extend through apertures spaced apart in the rigid guide member 43. The hinge extension 31 extends rigidly upward from the rigid guide member 43 between the first panel 34 and the second panel 35 and outward to pivotably engage the first panel 34 and the second panel 35. The hinge extension pivotably engages the first panel 34 and the second panel 35 by the first hinge leaf 98 and the second hinge leaf 99, respectively. The first hinge leaf 98 being secured to the first panel 34 and the second hinge leaf 99 being secured to the second panel 35. Portions of the hinge extension 31 hidden from view are shown in dashed lines. The arrangement described in this paragraph allows the hinge extension 31 to maintain a constant angle when the first bottom-loaded roller assembly 91 and the second bottom-loaded roller assembly 92 are fully positioned within either the first linear sill segment 97*a* or the second linear sill segment 97*b*. The inventor found that best performance is achieved when the constant angle is approximately 90°. The discussion for FIGS. 19 and 20 for the suspended trolley assembly 30 also apply to the bottom-loaded trolley assembly 90 of FIG. 37.

Referring to FIG. 38, the bottom-loaded trolley assembly 100 is illustrated with essentially the same structure as the suspended trolley assembly 50 of FIGS. 25-32 except it extends below the bottom rails 34*d*, 35*d* of the first panel 34 and the second panel 35, respectively. The bottom-loaded trolley assembly 100 includes a rigid guide member 43 positioned outside and above the sill track 97, a first bottom-loaded roller assembly 101 and the second bottom-loaded roller assembly 102 are spaced apart by the rigid guide member 43 and supported within the sill track 97. The rigid guide member 43 is shown positioned above the bottom rails 34*d*, 35*d* of the first panel 34 and the second panel 35, respectively. The first bottom-loaded roller assembly 101 includes a first body 101*a*, a first vertical bearing 101*b*, a first vertical shaft 101*c*, and optionally, a first horizontal roller 101*d*. The second bottom-loaded roller assembly 102 includes a second body 102*a*, a second vertical bearing 102*b*, a second vertical shaft 102*c*, and optionally, a second horizontal roller 102*d*. The first vertical bearing 101*b* is rotationally coupled to a first vertical shaft 101*c*. The second vertical bearing 102*b* is rotationally coupled to a second vertical shaft 102*c*. The bottom-loaded trolley assembly 100 includes a rigid guide member 43 positioned outside and above the sill track 97. The first bottom-loaded roller assembly 101 and the second bottom-loaded roller assembly 102 are spaced apart by the rigid guide member 43 and supported within the sill track 97. The bottom-loaded trolley assembly 100 moves along the sill track 97 via four vertical rollers positioned as shown in FIGS. 25 and 26. Only two of the four vertical rollers are shown in FIG. 38, second vertical roller 101*f* and fourth vertical roller 102*f*. The structure described above allows the bottom-loaded trolley assembly 100 to navigate the first linear sill segment 97*a* and second linear sill segment 97*b* even when there are relatively steep angles between the segments. The discussion for navigating the overhead linear track segments 58, 59 for FIG. 32 also applies to navigating the first linear sill segment 97*a* and the second linear sill segment 97*b* of FIG. 38.

Suspended folding panel system and a suspended trolley assembly for the suspended folding panel system, in several embodiments, has been described. In addition, a bottom-loaded folding panel system and bottom-loaded trolley for the bottom-loaded folding panel system, in several embodiments, has been described. It is not the intent of this disclosure to limit the claimed invention to the examples, variations, and exemplary embodiments described in the specification. Those skilled in the art will recognize that variations will occur when embodying the claimed invention in specific implementations and environments. For example, referring to FIG. 18, the size and spacing of the first upper helical bearing 41*b* and first lower helical bearing 41*c* could be changed in relation to the size and shape of the profile of the overhead guide track 37. Similarly, the size and spacing of the second upper helical bearing 42*b* and the second lower helical bearing 42*c* could be changed in relation to the size and shape of the profile of the overhead guide track 37. Referring to FIGS. 21-23, the size of the first body 51*a* and the second body 52*a* as well as the size and spacing of the first vertical roller 51*e*, second vertical roller 51*f*, third vertical roller 52*e*, and fourth vertical roller 52*f* could be changed in relationship to the size and shape of the profile of the overhead guide track 57. Similarly, the size and spacing of the components of FIGS. 37 and 38 can be adjusted to accommodate different size sill tracks or panel weight.

In FIGS. 6-10, 18-24, and 32-38 the first panel 34 and second panel 35 are illustrated as glazed panels with glass or other transparent or translucent infill. Solid infill such as aluminum, wood or insulated panels could readily be used in place of the glazed infill. In addition, it is the intent of the inventor that his suspended trolley assembly be used with a wide range of suspended folded panels, such as solid panels, hollow core panels, glazed infill panels, or non-glazed infill panels, glazed doors, solid or hollow core doors, and the like.

If a feature, advantage, or description is given for structural elements or their combinations the embodiment of FIGS. 6-20, then the same feature, advantage, or description can be applied to the embodiment of FIGS. 21-33 if present in that embodiment. Similarly, if a feature, advantage, or description is given for structural elements or their combinations the embodiment of FIGS. 21-33, then the same feature, advantage, or description can be applied to the embodiment of FIGS. 6-20 or the embodiments of FIGS. 37 and 38, if present in that embodiment.

It is possible to implement certain features described in separate embodiments in combination within a single embodiment. Similarly, it is possible to implement certain features described in single embodiments either separately or in combination in multiple embodiments. The inventor envisions that these variations fall within the scope of the claimed invention. For example, the bottom-loaded trolley assembly 90 of FIG. 37 or the bottom-loaded trolley assembly 100 of FIG. 38 can be applied in combination with the suspended trolley assembly 30 of FIGS. 6-18 or the suspended trolley assembly 50 of FIGS. 21-32.

"Optional" or "optionally" is used throughout this disclosure to describe features or structures that are optional. Not using the word optional or optionally to describe a feature or structure does not imply that the feature or structure is essential, necessary, or not optional. Describing an advantage of an embodiment, example, or feature of the suspended folding panel system 20 does not imply that the implementation or example is essential or required. However, when discussing advantages of the suspended folding panel system 20 over the prior art, part of the purpose of this is to distinguish the suspended folding panel system 20 from the prior art and to demonstrate part of the inventor's contribution to the art.

Using the word "or," as used in this disclosure is to be interpreted as the ordinary meaning of the word "or" (i.e., an inclusive or) For example, the phrase "A or B" can mean any of the following: A, B, A with B. For example, if one were to say, "I will wear a waterproof jacket if it snows or rains," the meaning is that the person saying the phrase intends to wear a waterproof jacket if it rains alone, if it snows alone, if it rains and snows in combination.

While the examples, exemplary embodiments, and variations are helpful to those skilled in the art in understanding the claimed invention, it should be understood that, the scope of the claimed invention is defined solely by the following claims and their equivalents.

What is claimed is:

1. A suspended folding panel system, comprising:

an overhead guide track;

a first panel and a second panel; and a suspended trolley assembly including a rigid guide member positioned outside and below the overhead guide track, a first top-loaded dual roller assembly and a second top-loaded dual roller assembly spaced apart by the rigid guide member and suspended within the overhead guide track, and a hinge extension extending rigidly downward from the rigid guide member between the first panel and the second panel and outward to pivotably engage the first panel and the second panel.

2. The suspended folding panel system of claim 1, wherein:

the overhead guide track includes a first linear track segment; and with the first top-loaded dual roller assembly and the second top-loaded dual roller assembly being positioned fully within the first linear track segment, the hinge extension maintains a constant angle with respect to the first linear track segment.

3. The suspended folding panel system of claim 1, wherein:

the overhead guide track includes a first linear track segment; and with the first top-loaded dual roller assembly and the second top-loaded dual roller assembly being positioned fully within the first linear track segment, the hinge extension maintains an angle of approximately 90° with respect to the first linear track segment.

4. The suspended folding panel system of claim 1, wherein:

the overhead guide track includes a first linear track segment and a second linear track segment extending perpendicularly or obliquely away from the first linear track segment; and the suspended trolley assembly is so configured that when both the first top-loaded dual roller assembly and the second top-loaded dual roller assembly both are positioned fully within the first linear track segment the hinge extension maintains a first constant angle with the first linear track segment, or so configured that when both the first top-loaded dual roller assembly and the second top-loaded dual roller assembly are positioned fully within the second linear track segment the hinge extension maintains a second constant angle with respect to the second linear track segment.

5. The suspended folding panel system of claim 1, wherein:

the first top-loaded dual roller assembly is rotatable about a first vertical rotational axis and the second top-loaded dual roller assembly is rotatable about a second vertical rotational axis spaced apart from the first vertical rotational axis.

6. The suspended folding panel system of claim 1, wherein:

the overhead guide track includes a first linear track segment and a second linear track segment extending perpendicularly or obliquely away from the first linear track segment; and the suspended trolley assembly being moved from the first linear track segment into the second linear track segment, the hinge extension maintains a constant angle with respect to the rigid guide member.

7. The suspended folding panel system of claim 1, wherein:

the first top-loaded dual roller assembly includes a first upper helical bearing and a first lower helical bearing rotationally coupled by a first vertical shaft;

the second top-loaded dual roller assembly includes a second upper helical bearing and a second lower helical bearing rotationally coupled by a second vertical shaft; and the first vertical shaft and the second vertical shaft spaced apart by the rigid guide member.

8. The suspended folding panel system of claim 1, wherein:

the first top-loaded dual roller assembly includes a first body, a first vertical roller and a second vertical roller rotationally coupled on opposite sides of the first body, and a first vertical shaft rotationally coupling the first body to the rigid guide member;

the second top-loaded dual roller assembly includes a second body, a third vertical roller and a fourth vertical roller rotationally coupled on opposite sides of the second body, a second vertical shaft rotationally coupling the second body to the rigid guide member; and the first vertical shaft and the second vertical shaft spaced apart by the rigid guide member.

9. A suspended trolley assembly, for suspending a first panel and a second panel on an overhead guide track, the overhead guide track including a first linear track segment and a second linear track segment extending perpendicularly or obliquely away from the first linear track segment, comprising:

a rigid guide member;

a first top-loaded dual roller assembly and a second top-loaded dual roller assembly spaced apart by the rigid guide member and suspendable within the overhead guide track, the rigid guide member is configured to be positioned outside and below the overhead guide track; and a hinge extension extending rigidly downward from the rigid guide member and configured to extend between the first panel and the second panel and outward to pivotably engage the first panel and the second panel.

10. The suspended trolley assembly of claim 9, wherein:

the first top-loaded dual roller assembly and the second top-loaded dual roller assembly being positioned fully within the first linear track segment, the hinge extension maintains a constant angle with respect to the first linear track segment.

11. The suspended trolley assembly of claim 9, wherein: with the first top-loaded dual roller assembly and the second top-loaded dual roller assembly being positioned fully within the first linear track segment, the hinge extension maintains an angle of approximately 90° with respect to the first linear track segment.

12. The suspended trolley assembly of claim 9, wherein: the suspended trolley assembly is so configured that when both the first top-loaded dual roller assembly and the second top-loaded dual roller assembly both are positioned fully within the first linear track segment the hinge extension maintains a first constant angle with the first linear track segment, or is so configured that when both the first top-loaded dual roller assembly and the second top-loaded dual roller assembly are positioned fully within the second linear track segment the hinge extension maintains a second constant angle with respect to the second linear track segment.

13. The suspended trolley assembly of claim 9, wherein: the first top-loaded dual roller assembly is rotatable about a first vertical rotational axis and the second top-loaded dual roller assembly is rotatable about a second vertical rotational axis spaced apart from the first vertical rotational axis.

14. The suspended trolley assembly of claim 9, wherein: the suspended trolley assembly being moved from the first linear track segment into the second linear track segment, the hinge extension maintains a constant angle with respect to the rigid guide member.

15. The suspended trolley assembly of claim 9, wherein: the first top-loaded dual roller assembly includes a first upper helical bearing and a first lower helical bearing rotationally coupled by a first vertical shaft to the rigid guide member;

the second top-loaded dual roller assembly includes a second upper helical bearing and a second lower helical bearing rotationally coupled by a second vertical shaft to the rigid guide member; and the first vertical shaft and the second vertical shaft spaced apart by the rigid guide member.

16. The suspended trolley assembly of claim 9, wherein: the first top-loaded dual roller assembly includes a first body, a first vertical roller and a second vertical roller rotationally coupled on opposite sides of the first body, and a first vertical shaft rotationally coupled to the first body;

the second top-loaded dual roller assembly includes a second body, a third vertical roller and a fourth vertical roller rotationally coupled on opposite sides of the second body, a second vertical shaft rotationally coupled to the second body; and the first vertical shaft and the second vertical shaft spaced apart by the rigid guide member.

17. A bottom-loaded folding panel system, comprising:

a sill track;

a first panel and a second panel; and a bottom-loaded trolley assembly including a rigid guide member positioned outside and above the sill track, a first bottom-loaded roller assembly and a second bottom-loaded roller assembly spaced apart by the rigid guide member and supported within the sill track, and a hinge extension extending rigidly upward from the rigid guide member between the first panel and the second panel and outward to pivotably engage the first panel and the second panel.

18. The bottom-loaded folding panel system of claim 17, wherein:

the sill track includes a first linear sill segment and a second linear sill segment extending perpendicularly or obliquely away from the first linear sill segment; and the bottom-loaded trolley assembly is so configured that when both the first bottom-loaded roller assembly and the second bottom-loaded roller assembly both are positioned fully within the first linear sill segment the hinge extension maintains a first constant angle with the first linear sill segment, or is so configured that when both the first bottom-loaded roller assembly and the second bottom-loaded roller assembly are positioned fully within the second linear sill segment, the hinge extension maintains a second constant angle with respect to the second linear sill segment.

19. The bottom-loaded folding panel system of claim 17, wherein:

the sill track includes a first linear sill segment; and with the first bottom-loaded roller assembly and the second bottom-loaded roller assembly being positioned fully within the first linear sill segment, the hinge extension maintains an angle of approximately 90° with respect to the first linear sill segment.

20. The bottom-loaded folding panel system of claim 17, wherein:

the first bottom-loaded roller assembly is rotatable about a first vertical rotational axis and the second bottom-loaded roller assembly is rotatable about a second vertical rotational axis spaced apart from the first vertical rotational axis.

* * * * *